US008947334B2

(12) United States Patent
Teranishi

(10) Patent No.: US 8,947,334 B2
(45) Date of Patent: Feb. 3, 2015

(54) LIQUID CRYSTAL DISPLAY DEVICE INCLUDING DRIVE SECTION FOR CONTROLLING TIMING OF PIXEL SWITCHING ELEMENTS, DRIVING METHOD OF THE SAME AND ELECTRONIC EQUIPMENT

(75) Inventor: Yasuyuki Teranishi, Aichi (JP)

(73) Assignee: Japan Display West Inc., Chita-gun, Aichi-ken (JP)

( * ) Notice: Subject to any disclaimer, the term of this patent is extended or adjusted under 35 U.S.C. 154(b) by 232 days.

(21) Appl. No.: 13/159,617

(22) Filed: Jun. 14, 2011

(65) Prior Publication Data

US 2011/0316819 A1 Dec. 29, 2011

(30) Foreign Application Priority Data

Jun. 24, 2010 (JP) ..... 2010-144152

(51) Int. Cl.
*G09G 3/36* (2006.01)

(52) U.S. Cl.
CPC ..... *G09G 3/3614* (2013.01); *G09G 3/3659* (2013.01); *G09G 2300/0804* (2013.01); *G09G 2300/0814* (2013.01); *G09G 2300/0852* (2013.01); *G09G 2300/0857* (2013.01); *G09G 2300/0861* (2013.01); *G09G 2320/0219* (2013.01); *G09G 2340/0428* (2013.01)
USPC ..... 345/90; 345/204

(58) Field of Classification Search
USPC ..... 345/90, 204
See application file for complete search history.

(56) References Cited

U.S. PATENT DOCUMENTS 5,952,989 A 9/1999 Koyama
8,310,638 B2 * 11/2012 Yamauchi et al. ..... 349/130

(Continued)

FOREIGN PATENT DOCUMENTS

CN 101750824 6/2010
JP 2009-98234 5/2009

OTHER PUBLICATIONS

European Patent Office, Communication pursuant to Article 94(3) EPC issued in connection with European Patent Application No. 11 167 834.8, dated Oct. 1, 2012. (6 pages).

(Continued)

*Primary Examiner* — Kwang-Su Yang
(74) *Attorney, Agent, or Firm* — K&L Gates LLP

(57) ABSTRACT

The present disclosure provides a liquid crystal display device including: for each pixel, a first switching element provided in common for a plurality of subpixels making up a pixel, the first switching element having its one end connected to a signal line; for each pixel, a plurality of second switching elements one provided for each subpixel, each of the plurality of second switching elements being connected between the pixel electrode of one of the plurality of subpixels and the other end of the first switching element; and a drive section adapted to turn ON and OFF the plurality of second switching elements in sequence during the ON period of the first switching element and turn OFF the second switching element that turns ON last in sequence first, and then turn OFF the first switching element.

11 Claims, 19 Drawing Sheets

(56) References Cited

U.S. PATENT DOCUMENTS

| | | | | |
|---|---|---|---|---|
| 2001/0045925 | A1 | 11/2001 | Libsch et al. | |
| 2003/0016201 | A1* | 1/2003 | Ayres et al. | 345/98 |
| 2003/0016202 | A1 | 1/2003 | Edwards et al. | |
| 2004/0017341 | A1 | 1/2004 | Maki | |
| 2005/0157539 | A1* | 7/2005 | Van Der Zaag et al. | 365/158 |
| 2005/0200788 | A1* | 9/2005 | Edwards | 349/139 |
| 2006/0232535 | A1* | 10/2006 | Toyozawa et al. | 345/90 |
| 2009/0096947 | A1 | 4/2009 | Teranishi et al. | |
| 2010/0149080 | A1* | 6/2010 | Teranishi et al. | 345/87 |

OTHER PUBLICATIONS

European Patent Office, Extended European Search Report, issued in connection with European Patent Application No. 11167834.8, dated Mar. 2, 2012. (10 pages).

European Office Action issued Oct. 22, 2013 in corresponding European Patent Application No. 11 167 834.8.

Chinese Office Action issued May 9, 2014 in corresponding Chinese Patent Application No. 2011101644680.

* cited by examiner

FIG.4A SIGNAL LINE POTENTIAL

FIG.4B $GATE_1$

FIG.4C $GATE_{2R}$

FIG.4D $GATE_{2G}$

FIG.4E $GATE_{2B}$

FIG.4F $PIX_R$

FIG.4G $PIX_G$

FIG.4H $PIX_B$

FIG.6A SIGNAL LINE POTENTIAL

FIG.6B $GATE_1$

FIG.6C $GATE_{2R}$

FIG.6D $GATE_{2G}$

FIG.6E $GATE_{2B}$

FIG.6F $PIX_R$

FIG.6G $PIX_G$

FIG.6H $PIX_B$

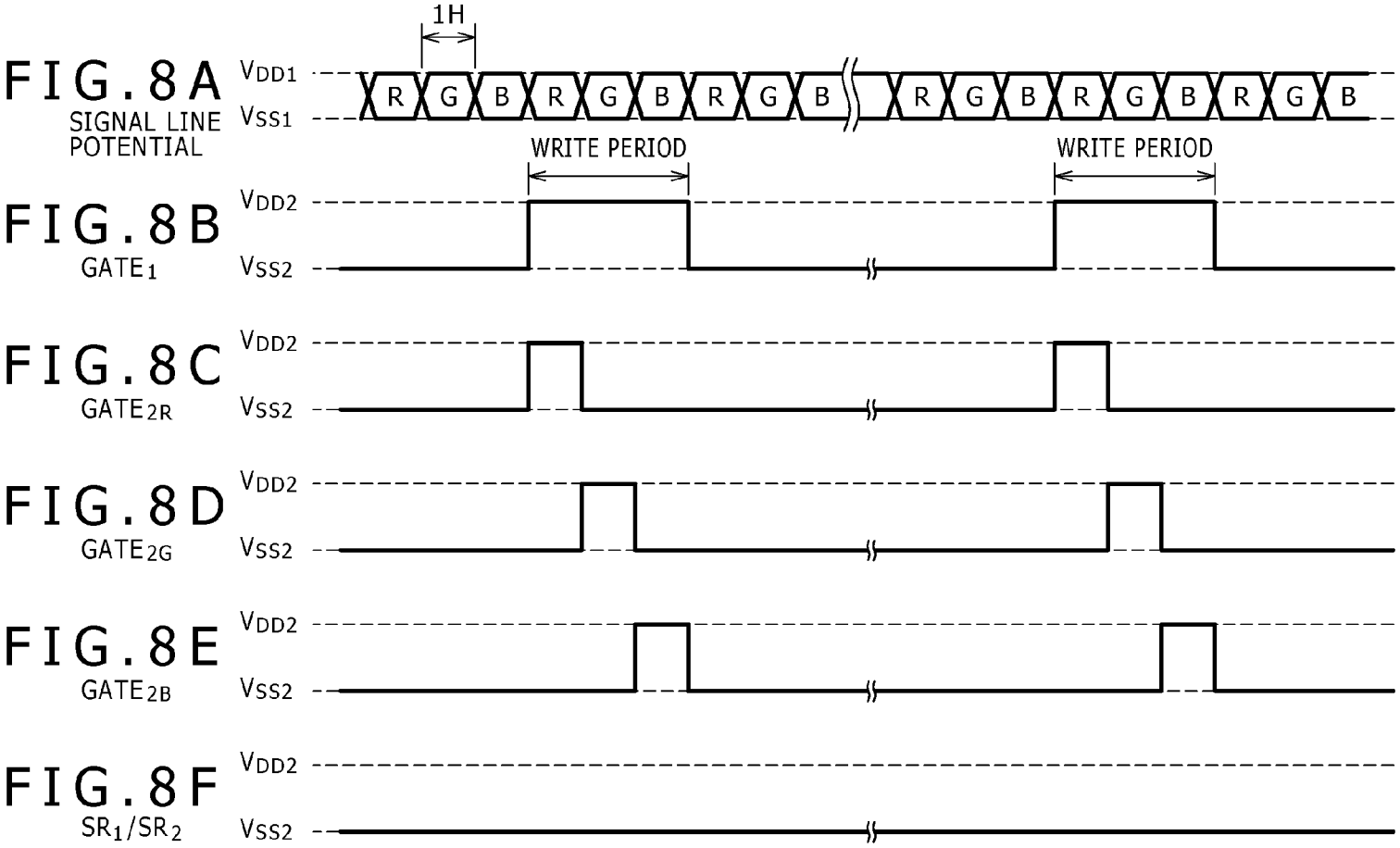
FIG.8A SIGNAL LINE POTENTIAL
FIG.8B $GATE_1$
FIG.8C $GATE_{2R}$
FIG.8D $GATE_{2G}$
FIG.8E $GATE_{2B}$
FIG.8F $SR_1/SR_2$ $GATE_{2R}$ $GATE_{2G}$ $GATE_{2B}$ $SR_1/SR_2$ $V_{CS}$ $PIX_R$ $PIX_G$ $PIX_B$ $GATE_{2G}$ $SR_1$ $SR_2$ $V_{CS}$ $GATE_{2R}$ $GATE_{2G}$ $GATE_{2B}$ $SR_1/SR_2$ $SR_3$ $V_{CS}$ $PIX_R$ $PIX_G$ $PIX_B$ $GATE_{2G}$ $SR_1$ $SR_2$ $SR_3$ $V_{CS}$

LIQUID CRYSTAL DISPLAY DEVICE INCLUDING DRIVE SECTION FOR CONTROLLING TIMING OF PIXEL SWITCHING ELEMENTS, DRIVING METHOD OF THE SAME AND ELECTRONIC EQUIPMENT

CROSS REFERENCES TO RELATED APPLICATIONS

The present application contains subject matter related to that disclosed in Japanese Priority Patent Application JP 2010-144152 filed in the Japan Patent Office on Jun. 24, 2010, the entire content of which is hereby incorporated by reference.

BACKGROUND

The present application relates to a liquid crystal display device, driving method of the same and electronic equipment, and more particularly, to a liquid crystal display device adopting the so-called in-pixel selector driving method, driving method of the same and electronic equipment having the same.

Some liquid crystal display devices adopt the so-called in-pixel selector driving method. This driving method writes a signal potential reflecting a gray level in sequence to a plurality of subpixels making up a pixel (main pixel) using a selector section provided in the pixel. The signal potential is supplied via a signal line disposed for each pixel. The selector section provided in a pixel may be hereinafter indicated as the "in-pixel selector section."

A liquid crystal display device adopting the in-pixel selector driving method includes first and second switching elements for each pixel. The first switching element is provided in common for a plurality of subpixels. The second switching elements are provided one for each of the plurality of subpixels (refer, for example, to Japanese Patent Laid-Open No. 2009-98234). The first switching element has its one end connected to the signal line. Each of the second switching elements is connected between the pixel electrode of one of the plurality of subpixels (more specifically, liquid crystal capacitors) and the other end of the first switching element.

The in-pixel selector section includes the first switching element and the plurality of second switching elements. In the in-pixel selector section, the plurality of second switching elements are turned ON and OFF in sequence during the ON period of the first switching element, thus allowing for the signal potential reflecting a gray level supplied via the signal line to be written in sequence to the plurality of subpixels.

Here, in order to ensure that the signal potential is reliably written to the plurality of subpixels in the in-pixel selector section, it is recommendable to reserve (set) as long a period of time as possible for writing the signal potential to the plurality of subpixels. In order to do so, it is inevitable to make the most of the ON period of the first switching element.

In order to make the most of the ON period of the first switching element, the second switching element to be turned ON and OFF last of all the second switching elements turns OFF at the same time as when the first switching element turns OFF. The reason for this is that the ON period of the first switching element is divided equally into the ON periods of the plurality of second switching elements.

SUMMARY

Incidentally, a parasitic capacitance is normally present between the control electrode of a switching element and a wire. Then, when the plurality of second switching elements turn OFF after having written a signal potential to the capacitive elements, the signal potential in the capacitive elements changes slightly due to parasitic capacitance coupling (capacitive coupling).

At this time, if the last second switching element and the first switching element make a transition from ON to OFF at the same time as described above, the coupling level due to parasitic capacitance of the two switching elements is approximately two-fold greater in the subpixel to which a signal potential is written last. That is, the coupling level for the subpixel to which a signal potential is written last differs from that for the subpixels to which a signal potential is written earlier. In other words, the condition affecting the subpixels due to parasitic capacitance coupling is different between the plurality of subpixels.

Here, we consider a case in which the plurality of subpixels are red (R), green (G) and blue (B) pixels. In this case, if the coupling condition (coupling level) for a switching element due to parasitic capacitance is different among the plurality of subpixels, the color of the subpixel to which a signal potential is written last varies more relative to the originally intended signal potential than the other colors of the subpixels, thus resulting in unbalance between the colors.

In light of the foregoing, it is desirable to provide a liquid crystal display device in which the condition affecting the plurality of subpixels due to coupling through parasitic capacitance at the control electrodes of the switching elements is the same for the subpixels, and provide a driving method of the same and electronic equipment having the same.

According to an embodiment, there is provided a liquid crystal display device. The liquid crystal display device includes, for each pixel, a first switching element and a plurality of second switching elements. The first switching element is provided in common for a plurality of subpixels making up a pixel. The first switching element has its one end connected to a signal line. The second switching elements are provided one for each subpixel. Each thereof is connected between the pixel electrode of one of the plurality of subpixels and the other end of the first switching element.

The plurality of second switching elements are turned ON and OFF in sequence during the ON period of the first switching element. Further, the second switching element that turns ON last in sequence turns OFF first, after which the first switching element turns OFF.

In the liquid crystal display device configured as described above, when the plurality of second switching elements are turned ON and OFF in sequence during the ON period of the first switching element, the last second switching element that turns ON last in sequence turns OFF first, after which the first switching element turns OFF. Here, the expression "the last second switching element turns OFF first, after which the first switching element turns OFF" means that the first switching element and the last second switching element turn OFF at different times. Therefore, the case is also included in which the first switching element turns OFF in a given period of time after the last second switching element turns OFF.

Thus, the first switching element turns OFF after the last second switching element turns OFF. As a result, the first switching element and the last second switching element turn OFF at different times. That is, the plurality of second switching elements are turned ON and OFF in sequence during the ON period of the first switching element. As a result, the condition for coupling through parasitic capacitance at the control electrodes of the switching elements is the same for the plurality of subpixels during the OFF period of any of the second switching elements.

The present application ensures that the condition affecting a plurality of subpixels due to coupling through parasitic capacitance at the control electrodes of the switching elements is the same for the subpixels when the in-pixel selector driving method is adopted.

Additional features and advantages are described herein, and will be apparent from the following Detailed Description and the figures.

BRIEF DESCRIPTION OF THE FIGURES

FIGS. 8A to 8F are timing waveform diagrams for describing the operation of the pixel circuit according to example 1 in analog display mode;

FIG. 16A is a perspective view as seen from the front, and FIG. 16B is a perspective view as seen from the rear;

FIG. 19A is a front view in an open position, FIG. 19B is a side view thereof, FIG. 19C is a front view in a closed position, FIG. 19D is a left-side view, FIG. 19E is a right-side view, FIG. 19F is a top view, and FIG. 19G is a bottom view.

DETAILED DESCRIPTION

Embodiments of the present application will be described below in detail with reference to the drawings.

1. Liquid crystal display device to which the present application is applied
   - 1-1. System configuration
   - 1-2. Sectional structure of the panel
   - 1-3. In-pixel selector driving method
2. Description of the liquid crystal display device according to an embodiment
   - 2-1. Example 1 (example using an inverter circuit)
   - 2-2. Example 2 (example using a latch circuit)
3. Modification example
4. Application examples (electronic equipment)

1. Liquid Crystal Display Device to Which the Present Application is Applied

1-1. System Configuration

Figure 1:
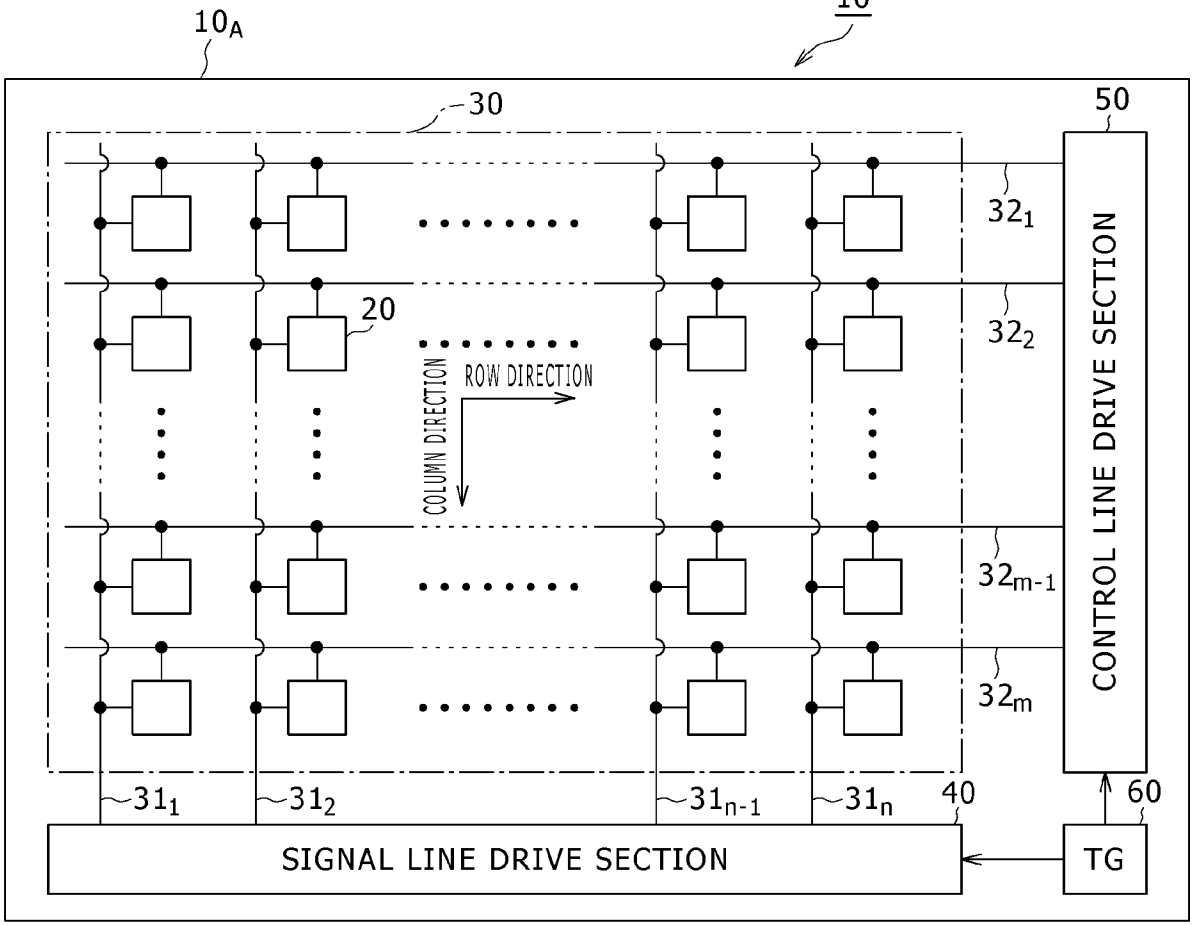
FIG. 1 is a system configuration diagram illustrating the outline of the configuration of an active matrix liquid crystal display device to which the present application is applied.

FIG. 1 is a system configuration diagram illustrating the outline of the configuration of an active matrix liquid crystal display device to which the present application is applied. The liquid crystal display device has two substrates (not shown) at least one of which is transparent. The two substrates are arranged to be opposed to each other with a predetermined gap therebetween. Liquid crystal is sealed between the two substrates.

A liquid crystal display device 10 according to the present application example includes a plurality of pixels 20, pixel array section 30 and drive section. Each of the plurality of pixels 20 has liquid crystal capacitors. The pixel array section 30 includes the pixels 20 arranged in a two-dimensional matrix. The drive section is arranged around the pixel array section 30 and includes, for example, a signal line drive section 40, control line drive section 50 and drive timing generation section 60. The drive section is integrated, for example, on the same substrate (liquid crystal display panel 11A) as the pixel array section 30 to drive the pixels 20 of the pixel array section 30.

Here, if the liquid crystal display device 10 is capable of color display, each pixel includes a plurality of subpixels each of which corresponds to the pixel 20. More specifically, each pixel in a color liquid crystal display device includes three subpixels or a subpixel adapted to emit red (R) light, another adapted to emit green (G) light and still another adapted to emit blue (B) light.

It should be noted, however, that the combination of subpixels is not limited to that of subpixels adapted to emit light in the three primary colors, namely, red, green and blue. Instead, each pixel may further include one or a plurality of additional subpixels adapted to emit different colors in addition to the subpixels adapted to emit light in the three primary colors. More specifically, for example, a subpixel adapted to emit white light may be added for improved luminance. Alternatively, one of complementary colors may be added for enhanced color gamut.

In FIG. 1, signal lines $\mathbf{31}_1$ to $\mathbf{31}_n$ (may be simply indicated as the signal lines 31) are disposed, one for each column of the pixels, in the column direction for the pixels arranged in m rows by n columns in the pixel array section 30. Further, control lines $\mathbf{32}_1$ to $\mathbf{32}_m$ (may be simply indicated as the control lines 32) are disposed one for each row of the pixels. Here, the term "column direction" refers to the direction in which the pixels in the pixel columns are arranged (that is, vertical direction), and the term "row direction" refers to the direction in which the pixels in the pixel rows are arranged (that is, horizontal direction).

Each of the signal lines $\mathbf{31}_1$ to $\mathbf{31}_n$ has its one end connected to one of the output terminals of the signal line drive section 40 associated with the signal line in question. The signal line drive section 40 outputs a signal potential $V_{sig}$ reflecting an arbitrary gray level to the associated signal line 31.

Although shown as a single wire in FIG. 1, each of the control lines $\mathbf{32}_1$ to $\mathbf{32}_m$ is not limited to being a single wire. Practically, each of the control lines $\mathbf{32}_1$ to $\mathbf{32}_m$ includes a plurality of wires. Each of the control lines $\mathbf{32}_1$ to $\mathbf{32}_m$ has its one end connected to one of the output terminals of the control line drive section 50 associated with the control line in question. The control line drive section 50 controls the writing of the signal potential $V_{sig}$ reflecting a gray level output from the signal line drive section 40 to the signal lines $\mathbf{31}_1$ to $\mathbf{31}_n$ to the pixels 20.

The drive timing generation section (TG: timing generator) 60 supplies a variety of drive pulses (timing signals) to the signal line drive section 40 and control line drive section 50 to drive these drive sections 40 and 50.

1-2. Sectional Structure of the Panel

Figure 2:
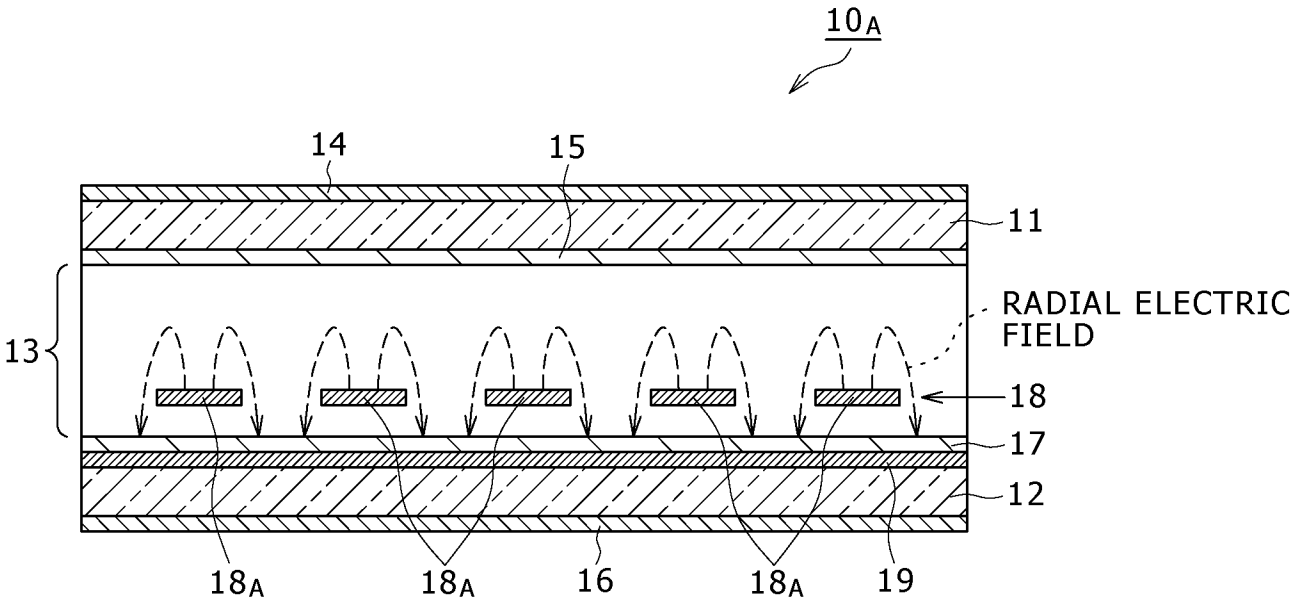
FIG. 2 is a sectional view illustrating an example of the sectional structure of a liquid crystal display panel (liquid crystal display device)

FIG. 2 is a sectional view illustrating an example of the sectional structure of the liquid crystal display panel (liquid crystal display device). As illustrated in FIG. 2, a liquid crystal display panel $\mathbf{10}_A$ includes two glass substrates 11 and 12 and liquid crystal layer 13. The glass substrates 11 and 12 are arranged to be opposed to each other with a predetermined gap therebetween. The liquid crystal layer 13 is sealed between the glass substrates 11 and 12.

A polarizer 14 is provided on the outer surface of one of the glass substrates or substrate 11, and an orientation film 15 is provided on the inner surface thereof. Similarly, a polarizer 16 is provided on the outer surface of the other glass substrates or substrate 12, and an orientation film 17 is provided on the inner surface thereof. The orientation films 15 and 17 are provided to align the group of liquid crystal molecules in the liquid crystal layer 13 in a given direction. Polyimide films are generally used as the orientation films 15 and 17.

A pixel electrode 18 and opposed electrode 19 are formed with transparent conductive films on the other glass substrate 12. In the present structural example, the pixel electrode 18 has, for example, five electrode branches $\mathbf{18}_A$ in the form of a comb with both ends of the electrode branches $\mathbf{18}_A$ connected together with connection sections (not shown). On the other hand, the opposed electrode 19 is formed below the electrode branches $\mathbf{18}_A$ (on the side of the glass substrate 12) in such a manner as to cover the entire area of the pixel array section 30.

Thanks to the electrode structure formed with the pixel electrode 18 in the form of a comb and the opposed electrode 19, radial electric fields develop between the electrode branches $\mathbf{18}_A$ and opposed electrode 19. This allows for electric fields to also have impact on the upper side of the pixel electrode 18. As a result, the group of liquid crystal molecules in the liquid crystal layer 13 can be aligned in a desired direction over the entire area of the pixel array section 30.

1-3. In-Pixel Selector Driving Method

The liquid crystal display device 10 according to the present application example configured as described above adopts the in-pixel selector driving method. As described earlier, the same method writes a signal potential reflecting a gray level in sequence to a plurality of subpixels making up a pixel (main pixel) using an in-pixel selector section. The signal potential is supplied via a signal line disposed for each pixel.

FIG. 1 illustrates a basic system configuration in which the signal line 31 is disposed for each subpixel assuming that each of the pixels 20 is a subpixel. In contrast, if the in-pixel selector driving method is adopted, the signal line 31 is disposed for each pixel (main pixel) when each main pixel includes subpixels $\mathbf{20}_R$, $\mathbf{20}_G$ and $\mathbf{20}_B$ adapted to emit light in the three primary colors, namely, red (R), green (G) and blue (B).

Figure 3:
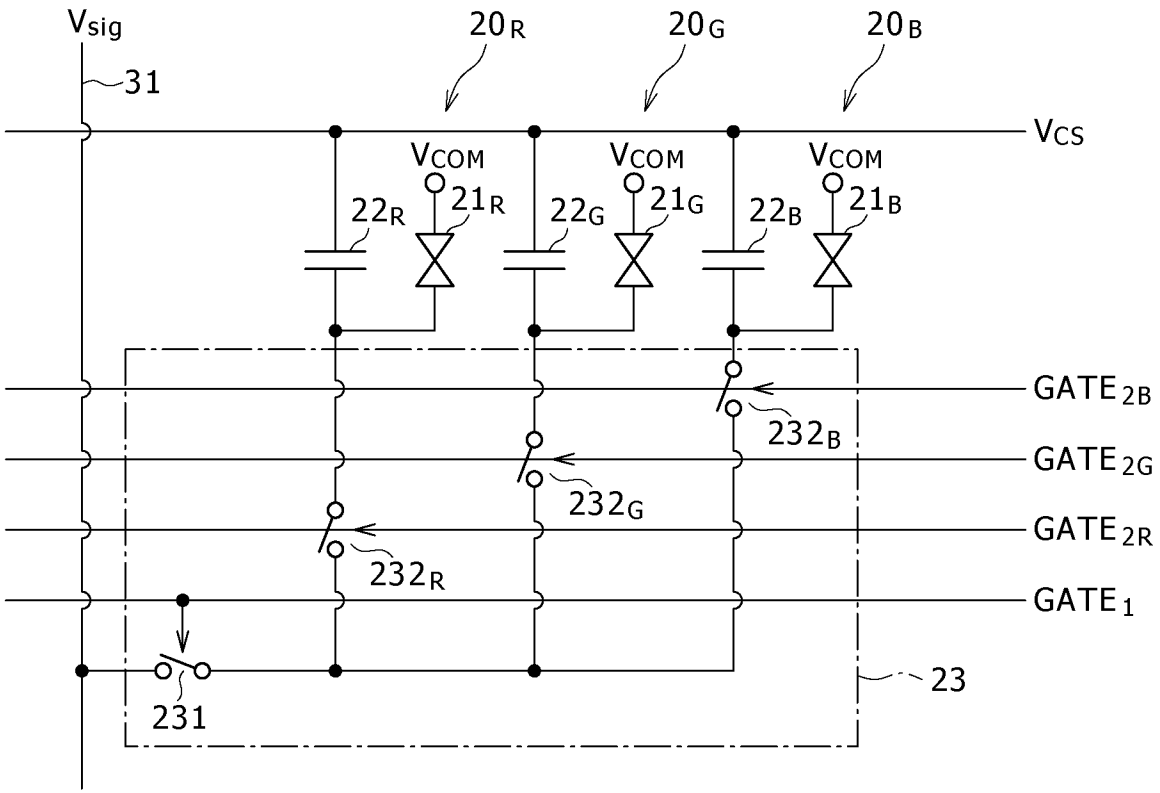
FIG. 3 is a circuit diagram illustrating a basic configuration example of a pixel circuit adopting the in-pixel selector driving method.
Figure 4:
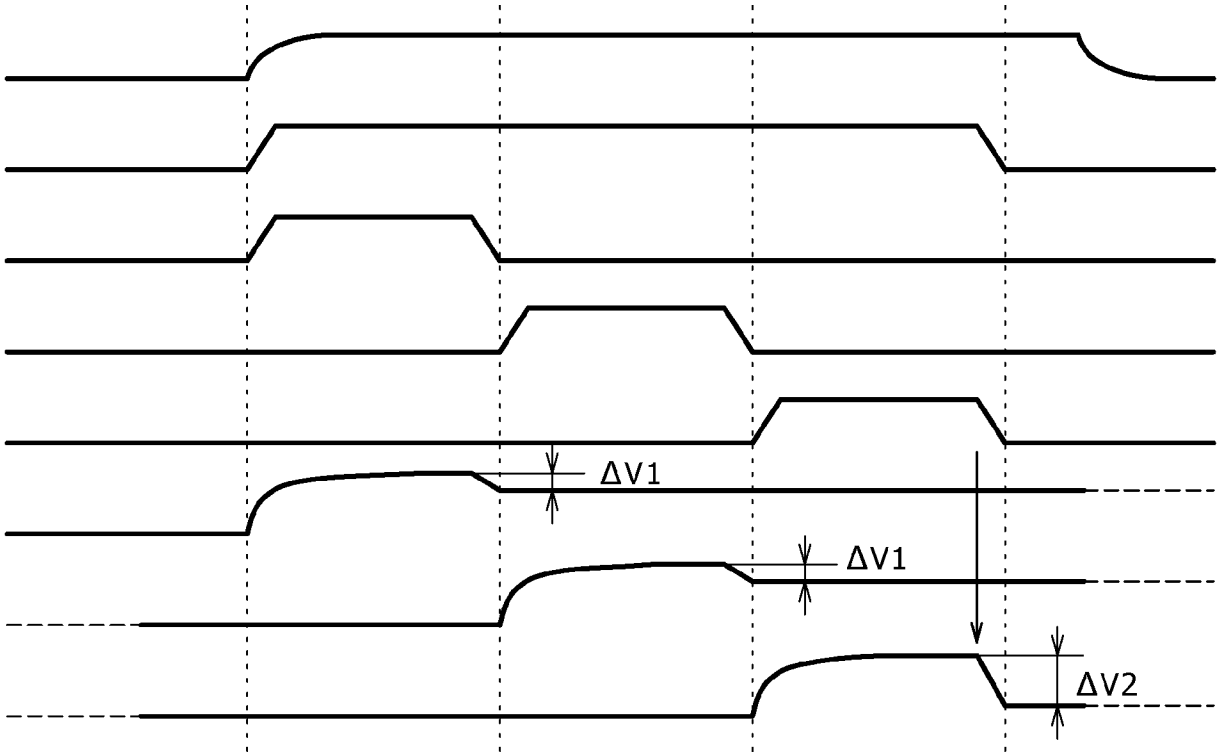
FIGS. 4A to 4H are timing waveform diagrams illustrating the timing relationship used to make the most of the ON period of a first switching element.

FIG. 3 is a circuit diagram illustrating a basic configuration example of a pixel circuit adopting the in-pixel selector driving method. In FIG. 3, like components to those shown in FIG. 1 are designated by the same reference symbols. In FIG. 3, the pixel 20 (pixel circuit) includes, for example, the red, green and blue subpixels $\mathbf{20}_R$, $\mathbf{20}_G$ and $\mathbf{20}_B$.

The subpixel $\mathbf{20}_R$ for red includes a liquid crystal capacitor $\mathbf{21}_R$ and capacitive element $\mathbf{22}_R$. The liquid crystal capacitor $\mathbf{21}_R$ refers to the capacitance that develops between the pixel electrode (corresponds to the pixel electrode 18 in FIG. 2) and the opposed electrode (corresponds to the opposed electrode 19 in FIG. 2) formed to be opposed to the pixel electrode for each pixel (subpixel). A common potential $V_{COM}$ is applied to the opposed electrode of the liquid crystal capacitor $\mathbf{21}_R$ for all the pixels. The pixel electrode of the liquid crystal capacitor $\mathbf{21}_R$ is electrically connected to one of the electrodes of the capacitive element $\mathbf{22}_R$.

The capacitive element $\mathbf{22}_R$ holds the signal potential $V_{sig}$ reflecting a gray level written from the signal line 31 by the write operation which will be described later. The capacitive element $\mathbf{22}_R$ will be hereinafter indicated as the holding capacitor $\mathbf{22}_R$. A potential (hereinafter indicated as the CS potential) $V_{CS}$ serving as a reference for the signal potential held by the holding capacitor $\mathbf{22}_R$ is applied to the other electrode of the holding capacitor $\mathbf{22}_R$. The CS potential $V_{CS}$ is roughly the same potential as the common potential $V_{COM}$.

Similarly, the subpixel $\mathbf{20}_G$ for green includes a liquid crystal capacitor $\mathbf{21}_G$ and capacitive element $\mathbf{22}_G$. The subpixel $\mathbf{20}_B$ for blue includes a liquid crystal capacitor $\mathbf{21}_B$ and capacitive element $\mathbf{22}_B$. The liquid crystal capacitor $\mathbf{21}_G$ and holding capacitor $\mathbf{22}_G$, and the liquid crystal capacitor $\mathbf{21}_B$ and holding capacitor $\mathbf{22}_B$ are basically connected in the same manner as their counterparts in the subpixel $\mathbf{20}_R$.

In the pixel 20 that includes the subpixels $\mathbf{20}_R$, $\mathbf{20}_G$ and $\mathbf{20}_B$, a selector section (in-pixel selector section) 23 is provided to write the signal potential $V_{sig}$ reflecting a gray level in sequence to the subpixels $\mathbf{20}_R$, $\mathbf{20}_G$ and $\mathbf{20}_B$. The signal potential $V_{sig}$ is supplied via the signal line 31.

The selector section 23 includes a first switching element 231 and three second switching elements $\mathbf{232}_R$, $\mathbf{232}_G$ and $\mathbf{232}_B$. The first switching element 231 is provided in common for the subpixels $\mathbf{20}_R$, $\mathbf{20}_G$ and $\mathbf{20}_B$. The second switching elements $\mathbf{232}_R$, $\mathbf{232}_G$ and $\mathbf{232}_B$ are provided respectively for the subpixels $\mathbf{20}_R$, $\mathbf{20}_G$ and $\mathbf{20}_B$.

The first switching element 231 has its one end connected to the signal line 31 and turns ON (becomes closed) when the signal potential $V_{sig}$ reflecting a gray level is written to the holding capacitor $\mathbf{22}_R$, $\mathbf{22}_G$ or $\mathbf{22}_B$. The signal potential $V_{sig}$ is supplied via the signal line 31. That is, the first switching element 231 turns ON to write (load) the signal potential $V_{sig}$ to (into) the pixel 20. The first switching element 231 is controlled to turn ON and OFF by a control signal $GATE_1$.

Each of the second switching elements $232_R$, $232_G$ and $232_B$ is connected between the other end of the first switching element 231 and the pixel electrode of the associated subpixel, i.e., one of the subpixels $20_R$, $20_G$ and $20_B$ (more specifically, liquid crystal capacitors $21_R$, $21_G$ and $21_B$). That is, each of the second switching elements $232_R$, $232_G$ and $232_B$ has its one end connected in common to the other end of the first switching element 231 and its other end connected to the pixel electrode of the associated subpixel, i.e., one of the subpixels $20_R$, $20_G$ and $20_B$.

Each of the second switching elements $232_R$, $232_G$ and $232_B$ turns ON when the signal potential $V_{sig}$ reflecting a gray level is written to the associated holding capacitor, i.e., one of the holding capacitors $22_R$, $22_G$ and $22_B$. That is, each of the second switching elements $232_R$, $232_G$ and $232_B$ turns ON to write the signal potential $V_{sig}$, loaded by the first switching element 231, to the associated holding capacitor, i.e., one of the holding capacitors $22_R$, $22_G$ and $22_B$. The second switching elements $232_R$, $232_G$ and $232_B$ are controlled to turn ON and OFF by control signals $GATE_{2R}$, $GATE_{2G}$ and $GATE_{2B}$.

As described above, in the in-pixel selector driving method using the selector 23 provided in the pixel 20, it is only necessary to dispose the single signal line 31 for each of the pixels 20, that is, in common for the subpixels $20_R$, $20_G$ and $20_B$, thus contributing to simpler wiring structure than the wiring structure adapted to dispose the plurality of signal lines 31, one for each of the subpixels $20_R$, $20_G$ and $20_B$.

Here, in order to ensure that the signal potential $V_{sig}$ is reliably written to the subpixels $20_R$, $20_G$ and $20_B$, it is recommendable to reserve (set) as long a period of time as possible for writing the signal potential $V_{sig}$ to the subpixels $20_R$, $20_G$ and $20_B$. In order to reserve as long a period of time as possible for writing the signal potential $V_{sig}$, it is inevitable to make the most of the ON period of the first switching element 231.

In order to make the most of the ON period of the first switching element 231, the second switching element to be turned ON and OFF last of all the second switching elements $232_R$, $232_G$ or $232_B$ turns OFF at the same time as when the first switching element 231 turns OFF. Assuming, for example, that the second switching elements $232_R$, $232_G$ or $232_B$ turn ON and OFF in this sequence, the last switching element $232_B$ turns OFF at the same time as when the first switching element 231 turns OFF.

FIGS. 4A to 4H are timing waveform diagrams illustrating the timing relationship used to make the most of the ON period of the first switching element 231.

FIGS. 4A to 4E illustrate the waveforms of the potential $V_{sig}$ of the signal line 31 and the control signals $GATE_1$, $GATE_{2R}$, $GATE_{2G}$ and $GATE_{2B}$, respectively. Further, FIGS. 4F and 4H illustrate the waveforms of potentials $PIX_R$, $PIX_G$ and $PIX_B$ held by the holding capacitors $22_R$, $22_G$ and $22_B$, respectively.

In order to make the most of the ON period of the first switching element 231 as illustrated in FIGS. 4A to 4H, it is only necessary to divide the active period (high period in the present example) of the control signal $GATE_1$ adapted to control the first switching element ON and OFF equally among the subpixels $20_R$, $20_G$ and $20_B$, that is, divide the active period into three equal parts. By dividing the active period of the control signal $GATE_1$ into three equal parts, the control signal $GATE_{2B}$ adapted to control the last switching element $232_B$ ON and OFF makes a transition to an inactive state at the same time as when the control signal $GATE_1$ makes a transition to an inactive state.

Incidentally, a parasitic capacitance is normally present between the control electrode of a switching element and a wire. An electronic switch such as MOS transistor is generally used as a switching element. If MOS transistors are used, for example, as the first switching element 231 and second switching elements $232_R$, $232_G$ and $232_B$, the gate electrodes of the MOS transistors serve as the control electrodes of the switching elements. Therefore, parasitic capacitance is present between the gate electrode of each of the MOS transistors and the wire electrically connected to the source/drain region.

In the presence of parasitic capacitance at the control electrodes of the second switching elements $232_R$, $232_G$ and $232_B$, a capacitive coupling develops when the same elements $232_R$, $232_G$ and $232_B$ turn OFF after the signal potential $V_{sig}$ has been written to the holding capacitors $22_R$, $22_G$ and $22_B$. Then, this parasitic coupling sends a potential to the holding capacitors $22_R$, $22_G$ and $22_B$, thus changing the potentials $PIX_R$, $PIX_G$ and $PIX_B$ held respectively by the holding capacitors $22_R$, $22_G$ and $22_B$.

More specifically, as is clear from FIGS. 4A to 4H, the second switching elements $232_R$ and $232_G$ to be turned ON and OFF earlier turn OFF at different times from when the first switching element 231 turns OFF. Therefore, the potentials $PIX_R$ and $PIX_G$ held respectively by the holding capacitors $22_R$ and $22_G$ decline slightly, i.e., by $\Delta V1$. The potential $\Delta V1$ at this time is determined by the parasitic capacitance present at the control electrodes of the second switching elements $232_R$ and $232_G$.

On the other hand, the second switching element $232_B$ to be turned ON and OFF last turns OFF at the same time as when the first switching element 231 turns OFF. Therefore, the potential $PIX_B$ held by the holding capacitors $22_B$ declines by $\Delta V2$ that is larger than $\Delta V1$. The potential $\Delta V2$ at this time is determined by the parasitic capacitance present at the control electrodes of the first switching element 231 and the second switching element $232_B$.

That is, if the last second switching element $232_B$ and first switching element 231 make a transition from an ON to OFF state at the same time, the coupling level due to parasitic capacitances of the two switching elements 231 and 232B is approximately two-fold greater in the subpixel $20_B$ to which a signal potential is written last. Therefore, the coupling level of the subpixel $20_B$ to which a signal potential is written last, i.e., the change $\Delta V2$ in the potential $PIX_B$ held by the holding capacitor $22_B$, differs from the coupling level of the subpixels $20_R$ and $20_G$ to which a signal potential is written earlier, i.e., the change $\Delta V1$ in the potentials $PIX_R$ and $PIX_G$ held respectively by the holding capacitors $22_R$ and $22_G$.

As described above, if the changes in the held potentials $PIX_R$, $PIX_G$ and $PIX_B$ are different between the plurality of subpixels $20_R$, $20_G$ and $20_B$, the change relative to the intended signal potential is greater in the subpixel $20_B$ to which a signal potential is written last than in the other subpixels $20_R$ and $20_G$.

As is well known, in a liquid crystal display device, the change in the held potential PIX caused by coupling due to parasitic capacitance present at the control electrode of a switching element (generally a write transistor adapted to write the signal potential $V_{sig}$) is compensated for by the common potential $V_{COM}$. More specifically, the change is compensated for by applying an offset to the common potential $V_{COM}$ associated with the change in the held potential PIX.

Here, the common potential $V_{COM}$ is a potential applied to the opposed electrode of the liquid crystal capacitors $21_R$, $21_G$ and $21_B$ for all the pixels as described earlier. Therefore, the change $\Delta V1$ in the potentials $PIX_R$ and $PIX_G$ held respectively by the holding capacitors $22_R$ and $22_G$ can be compensated for by adjusting the common potential $V_{COM}$. However, it is difficult to compensate for the change $\Delta V2$ in the potential $PIX_B$ held by the holding capacitor $22_B$.

Therefore, the desired signal potential $V_{sig}$ can be written to the subpixels $20_R$ and $20_G$ to which the signal potential $V_{sig}$ is written earlier. However, it is difficult to write the desired signal potential $V_{sig}$ to the subpixel $20_B$ to which the signal potential $V_{sig}$ is written last. This leads to imbalance between the colors, namely, red, green and blue.

2. Description of the Liquid Crystal Display Device According to an Embodiment The liquid crystal display device according to an embodiment described below has been designed to ensure that the condition affecting a plurality of subpixels due to coupling through parasitic capacitance at the control electrodes of the switching elements is the same for the subpixels when the in-pixel selector driving method is adopted.

In the present embodiment, a description will be also given assuming that the pixel 20 includes the red, green and blue subpixels $20_R$, $20_G$ and $20_B$. However, the combination of subpixels is not limited to that of subpixels adapted to emit light in the three primary colors, namely, red, green and blue. That is, each pixel may further include one or a plurality of additional subpixels adapted to emit different colors in addition to the subpixels adapted to emit light in the three primary colors. More specifically, for example, a subpixel adapted to emit white light may be added for improved luminance. Alternatively, one of complementary colors may be added for enhanced color gamut.

Figure 5:
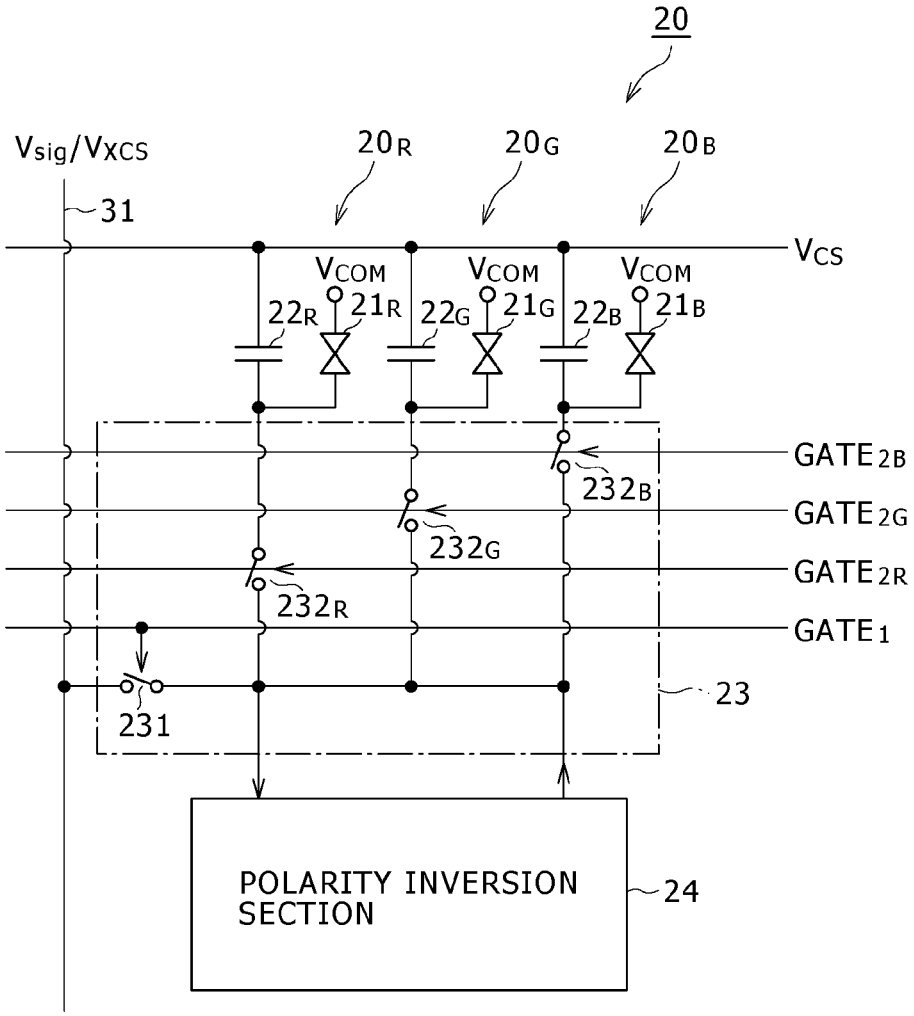
FIG. 5 is a circuit diagram illustrating a configuration example of a pixel of an active matrix liquid crystal display device according to an embodiment.
Figure 6:
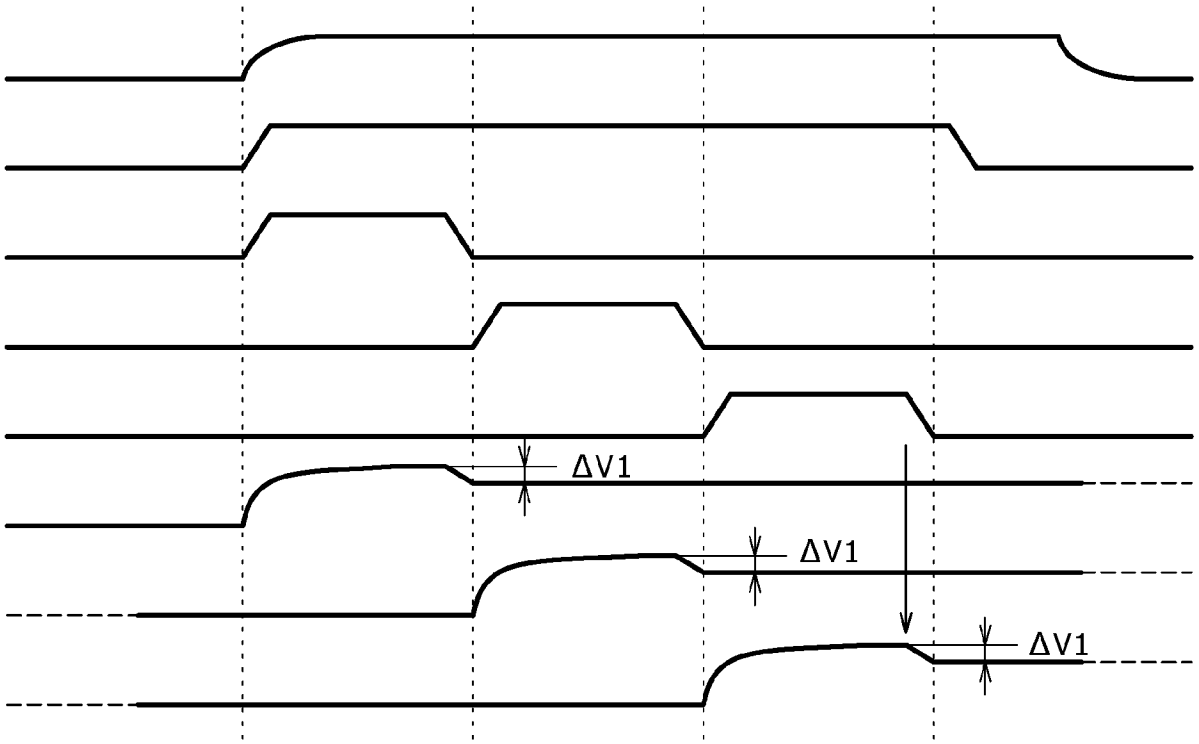
FIGS. 6A to 6H are timing waveform diagrams for describing the operation of the pixel circuit in the liquid crystal display device according to the present embodiment.

FIG. 5 is a circuit diagram illustrating a configuration example of a pixel of the active matrix liquid crystal display device according to an embodiment. In FIG. 5, like components to those shown in FIG. 3 are designated by the same reference symbols.

The pixel 20 according to the present embodiment also adopts the in-pixel selector driving method. That is, in the pixel 20 that includes the subpixels $20_R$, $20_G$ and $20_B$, the selector section 23 is provided to write the signal potential $V_{sig}$ reflecting a gray level in sequence to the subpixels $20_R$, $20_G$ and $20_B$. The signal potential $V_{sig}$ is supplied via the signal line 31.

The selector section 23 includes the first switching element 231 and three second switching elements $232_R$, $232_G$ and $232_B$. The first switching element 231 is provided in common for the subpixels $20_R$, $20_G$ and $20_B$. The second switching elements $232_R$, $232_G$ and $232_B$ are provided respectively for the subpixels $20_R$, $20_G$ and $20_B$.

The first switching element 231 has its one end connected to the signal line 31 and turns ON (becomes closed) when the signal potential $V_{sig}$ reflecting a gray level is written to the holding capacitor $22_R$, $22_G$ or $22_B$. That is, the first switching element 231 turns ON to write (load) the signal potential $V_{sig}$ to (into) the pixel 20. The first switching element 231 is controlled to turn ON and OFF by the control signal $GATE_1$.

Each of the second switching elements $232_R$, $232_G$ and $232_B$ is connected between the other end of the first switching element 231 and the pixel electrode of the associated subpixel, i.e., one of the subpixels $20_R$, $20_G$ and $20_B$ (more specifically, liquid crystal capacitors $21_R$, $21_G$ and $21_B$). That is, each of the second switching elements $232_R$, $232_G$ and $232_B$ has its one end connected in common to the other end of the first switching element 231 and its other end connected to the pixel electrode of the associated subpixel, i.e., one of the subpixels $20_R$, $20_G$ and $20_B$.

Each of the second switching elements $232_R$, $232_G$ and $232_B$ turns ON when the signal potential $V_{sig}$ reflecting a gray level is written to the associated holding capacitor, i.e., one of the holding capacitors $22_R$, $22_G$ and $22_B$. That is, each of the second switching elements $232_R$, $232_G$ and $232_B$ turns ON to write the signal potential $V_{sig}$, loaded by the first switching element 231, to the associated holding capacitor, i.e., one of the holding capacitors $22_R$, $22_G$ and $22_B$. The second switching elements $232_R$, $232_G$ and $232_B$ are controlled to turn ON and OFF by control signals $GATE_{2R}$, $GATE_{2G}$ and $GATE_{2B}$.

The pixel 20 according to the present embodiment incorporates a memory adapted to store image data in addition to adopting the in-pixel selector driving method. The memory incorporated in the pixel 20 allows for display in two modes, i.e., analog display mode and memory display mode. Here, the term "analog display mode" refers to a mode in which the gray level of the pixel 20 is displayed in an analog manner. On the other hand, the term "memory display mode" refers to a mode in which the gray level of the pixel 20 is displayed in a digital manner based on binary information (logic "1" or "0") stored in the memory.

In memory display mode, information stored in the memory is used. Therefore, it is not necessary to write the signal potential reflecting a gray level every frame. As a result, the memory display mode consumes less power than the analog display mode in which the signal potential reflecting a gray level is written every frame.

An SRAM (Static Random Access Memory), DRAM (Dynamic Random Access Memory) or other storage element may be used as a memory incorporated in the pixel 20. A DRAM is generally known to be simpler in structure than an SRAM. It should be noted, however, that a DRAM is refreshed to retain the data.

In the present embodiment, a description will be given of a case in which a DRAM, simpler in structure than an SRAM, is incorporated in the pixel 20. More specifically, the pixel 20 according to the present embodiment uses the holding capacitors $22_R$, $22_G$ and $22_B$ of the subpixels $20_R$, $20_G$ and $20_B$ as a DRAM. Using a DRAM as a memory incorporated in the pixel 20 contributes to simpler pixel structure, making this configuration more advantageous than that using an SRAM in terms of downsizing of the pixel 20.

The pixel 20 according to the present embodiment includes, in addition to the selector section 23 adapted to achieve the in-pixel selector driving method, a polarity inversion section 24 adapted to permit the use of the holding capacitors $22_R$, $22_G$ and $22_B$ of the subpixels $20_R$, $20_G$ and $20_B$ as a DRAM. The polarity inversion section 24 is provided in common for the subpixels $20_R$, $20_G$ and $20_B$. The same section 24 inverts the polarity of the signal potentials held by the holding capacitors $22_R$, $22_G$ and $22_B$ of the subpixels $20_R$, $20_G$ and $20_B$ and rewrites the signal potentials, whose polarity has been inverted, to the holding capacitors $22_R$, $22_G$ and $22_B$ for the refresh operation.

According to the embodiment, there are provided two display modes, i.e., analog display mode and memory display mode. The signal line drive section 40 illustrated in FIG. 1 outputs the analog potential $V_{sig}$ in analog display mode and a binary potential $V_{XCS}$ in memory display mode to the associated signal line 31 as a signal potential reflecting an arbitrary gray level. Further, the signal line drive section 40 outputs a signal potential reflecting a necessary gray level to the associated signal line 31 even in memory display mode if the logic level of the signal potential held in the pixel 20 is changed.

As described above, in the pixel circuit including the polarity inversion section 24 adapted to perform the polarity inversion (logic inversion) of the potentials held by the holding capacitors $22_R$, $22_G$ and $22_B$ and the refresh operation of these capacitors, the first switching element 231 is provided in common for the subpixels $20_R$, $20_G$ and $20_B$. The reason for this is that it is necessary to perform the polarity inversion and refresh operation of the potentials held by the holding capacitors $22_R$, $22_G$ and $22_B$ in sequence, with the signal potential held by the same capacitors $22_R$, $22_G$ and $22_B$.

In the selector section 23, the first switching element 231 turns ON in a first operation mode adapted to write the signal potential ($V_{sig}$ or $V_{XCS}$) reflecting a gray level to the holding capacitors $22_R$, $22_G$ and $22_B$. That is, the first switching element 231 turns ON in the first operation mode to write (load) the signal potential ($V_{sig}$ or $V_{XCS}$) to (into) the pixel 20.

The first switching element 231 turns OFF in a second operation mode. The second operation mode is adapted to read the signal potentials held by the holding capacitors $22_R$, $22_G$ and $22_B$, invert the polarity of the same potentials with the polarity inversion section 24 and rewrite the potentials, whose polarity has been inverted, to the holding capacitors $22_R$, $22_G$ and $22_B$. The first switching element 231 is controlled to turn ON and OFF by the control signal $GATE_1$.

The second switching elements $232_R$, $232_G$ and $232_B$ turn ON during a read period in which the signal potentials held by the holding capacitors $22_R$, $22_G$ and $22_B$ are read and during a rewrite period in which the potentials, whose polarity has been inverted, are rewritten to the holding capacitors $22_R$, $22_G$ and $22_B$ in the first and second operation modes. The second switching elements $232_R$, $232_G$ and $232_B$ turn OFF in other periods. The second switching elements $232_R$, $232_G$ and $232_B$ are controlled to turn ON and OFF by control signals $GATE_{2R}$, $GATE_{2G}$ and $GATE_{2B}$.

As described above, in the liquid crystal display device according to the present embodiment adopting the in-pixel selector driving method, the second switching element to be turned ON last during selector driving turns OFF first, after which the first switching element turns OFF. More specifically, if the second switching elements $232_R$, $232_G$ and $232_B$ turn ON and OFF in the order of red, green and blue, the last second switching element $232_B$ turns OFF first, after which the first switching element 231 turns OFF. This driving is performed by the control line drive section 50 illustrated in FIG. 1.

Here, the expression "the last second switching element $232_B$ turns OFF first, after which the first switching element 231 turns OFF" means that the first switching element 231 and the last second switching element $232_B$ turn OFF at different times. Therefore, the case is also included in which the first switching element 231 turns OFF in a given period of time after the last second switching element $232_B$ turns OFF.

As described above, the last second switching element $232_B$ turns OFF first, after which the first switching element 231 turns OFF. As a result, the last second switching element $232_B$ and first switching element 231 turn OFF at different times. That is, the second switching elements $232_R$, $232_G$ and $232_B$ turn ON and OFF in sequence during the ON period of the first switching element 231.

This ensures that the condition affecting the plurality of subpixels $20_R$, $20_G$ and $20_B$ due to coupling through parasitic capacitance at the control electrodes of the switching elements is the same for the subpixels $20_R$, $20_G$ and $20_B$ during the OFF period of any of the second switching elements $232_R$, $232_G$ and $232_B$. A detailed description thereof will be given with reference to the timing waveform diagram illustrated in FIGS. 6A to 6H.

FIGS. 6A to 6H are timing waveform diagrams for describing the operation of the pixel circuit in the liquid crystal display device according to the present embodiment.

FIGS. 6A to 6E illustrate the waveforms of the potential $V_{sig}$ of the signal line 31 and the control signals $GATE_1$, $GATE_{2R}$, $GATE_{2G}$ and $GATE_{2B}$, respectively. Further, FIGS. 6F and 6H illustrate the waveforms of potentials $PIX_R$, $PIX_G$ and $PIX_B$ held respectively by the holding capacitors $22_R$, $22_G$ and $22_B$, respectively.

When the second switching elements $232_R$, $232_G$ and $232_B$ turn ON and OFF in the order of red, green and blue as illustrated in FIGS. 6A to 6H, the last second switching element $232_B$ turns OFF first, after which the first switching element 231 turns OFF. More specifically, the control signal $GATE_{2B}$ for the second switching element $232_B$ makes a transition from high to low level first, after which the control signal $GATE_1$ for the first switching element 231 makes a transition from high to low level first.

Thanks to this timing relationship, the control signals $GATE_{2R}$, $GATE_{2G}$ and $GATE_{2B}$ make a transition from high to low level in sequence during the active period (high period) of the control signal $GATE_1$. That is, the control signal $GATE_{2B}$ for the second switching element $232_B$ makes a transition from high to low level earlier than the control signal $GATE_1$ as do the control signals $GATE_{2R}$ and $GATE_{2G}$.

As described above, by allowing for the control signal $GATE_{2B}$ to make a transition from high to low level earlier than the control signal $GATE_1$, it is possible to ensure that the condition affecting the subpixels $20_R$, $20_G$ and $20_B$ due to coupling through parasitic capacitance is the same for these subpixels. That is, all the potentials $PIX_R$, $PIX_G$ and $PIX_B$ held respectively by the holding capacitors $22_R$, $22_G$ and $22_B$ change by $\Delta V1$ due to coupling through parasitic capacitance in the subpixels $20_R$, $20_G$ and $20_B$.

The same change $\Delta V1$ can be compensated for in common for all the subpixels $20_R$, $20_G$ and $20_B$ by applying an offset, appropriate to the change $\Delta V1$, to the common voltage $V_{COM}$ by means of the adjustment technique of the common voltage $V_{COM}$ described earlier. This makes it possible for the holding capacitors $22_R$, $22_G$ and $22_B$ of the subpixels $20_R$, $20_G$ and $20_B$ to hold desired signal potentials, thus avoiding the unbalance between the colors due to coupling through parasitic capacitance.

In order to establish the above timing relationship, assuming that the length of the active period (high period) of the control signal $GATE_1$ is fixed, the active period of each of the control signals $GATE_{2R}$, $GATE_{2G}$ and $GATE_{2B}$ is inevitably shorter than in FIGS. 4A to 4H. This means that the length of the write period for the second switching elements $232_R$, $232_G$ and $232_B$ to write the signal potential $V_{sig}$ respectively to the subpixels $20_R$, $20_G$ and $20_B$ is slightly shorter than in the case shown in FIGS. 4A to 4H.

However, it can be said that maintaining balance between the colors by ensuring that the condition for coupling through parasitic capacitance is the same for the subpixels $20_R$, $20_G$ and $20_B$ more than offsets the disadvantage of a slightly shorter write period for writing the signal potential $V_{sig}$ to the subpixels $20_R$, $20_G$ and $20_B$.

It should be noted that a case has been described in the present example in which the present application is applied to the pixel 20 incorporating a memory. However, the application of the present application is not limited to the pixel 20 incorporating a memory. The present application is applicable to the pixel 20 in general that adopts the in-pixel selector driving method.

In the liquid crystal display device according to the present embodiment, an inverter circuit or latch circuit can be, for example, used as the polarity inversion section 24. A description will be given below of specific examples of the polarity inversion section 24.

2-1. Example 1

Figure 7:
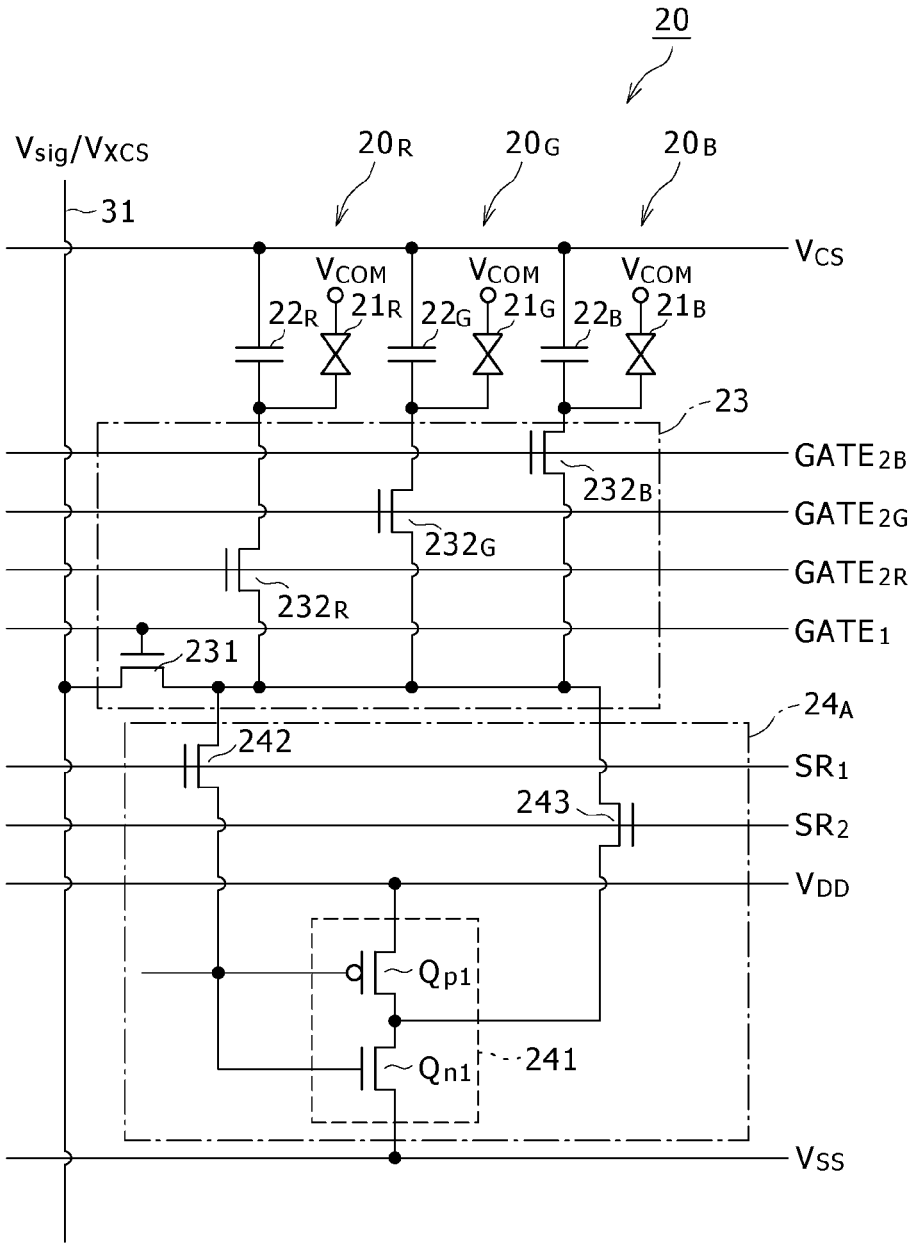
FIG. 7 is a circuit diagram illustrating the pixel circuit according to example 1.

FIG. 7 is a circuit diagram illustrating the pixel circuit according to example 1. In FIG. 7, like components to those shown in FIG. 5 are designated by the same reference symbols.

In the pixel circuit according to example 1, a polarity inversion section $\mathbf{24}_A$ includes an inverter circuit 241, third switching element 242 and fourth switching element 243. In the present example 1, thin film transistors are, for example, used as the first switching element 231, second switching elements $\mathbf{232}_R$, $\mathbf{232}_G$ and $\mathbf{232}_B$, third switching element 242 and fourth switching element 243.

These switching elements 231, $\mathbf{232}_R$, $\mathbf{232}_G$, $\mathbf{232}_B$, 242 and 243 will be hereinafter indicated as the switching transistors 231, $\mathbf{232}_R$, $\mathbf{232}_G$, $\mathbf{232}_B$, 242 and 243. Although N-channel MOS transistors are used as the switching transistors 231, $\mathbf{232}_R$, $\mathbf{232}_G$, $\mathbf{232}_B$, 242 and 243 here, P-channel MOS transistors may also be used instead.

Circuit Configuration

In FIG. 7, the selector section 23 has basically the same circuit configuration as that shown in FIG. 5 except that the first switching element 231 and second switching elements $\mathbf{232}_R$, $\mathbf{232}_G$ and $\mathbf{232}_B$ are replaced by MOS transistors.

That is, the first switching transistor 231 has one of its main electrodes (drain or source electrode) connected to the signal line 31. The same transistor 231 goes into conduction when the signal potential ($V_{sig}$ or $V_{XCS}$) reflecting a gray level is written to (loaded into) the pixel 20 from the signal line 31 under control of the control signal $GATE_1$.

The second switching transistor $\mathbf{232}_R$ has one of its main electrodes connected in common to the pixel electrode of the liquid crystal capacitor $\mathbf{21}_R$ and one of the electrodes of the holding capacitor $\mathbf{22}_R$. The second switching transistor $\mathbf{232}_R$ has its other main electrode connected to the other main electrode of the first switching transistor 231. The same transistor $\mathbf{232}_R$ goes into conduction when the signal potential ($V_{sig}$ or $V_{XCS}$) reflecting a gray level is written to the holding capacitor $\mathbf{22}_R$ under control of the control signal $GATE_{2R}$ for red.

The second switching transistor $\mathbf{232}_G$ has one of its main electrodes connected in common to the pixel electrode of the liquid crystal capacitor $\mathbf{21}_G$ and one of the electrodes of the holding capacitor $\mathbf{22}_G$. The second switching transistor $\mathbf{232}_G$ has its other main electrode connected to the other main electrode of the first switching transistor 231. The same transistor $\mathbf{232}_G$ goes into conduction when the signal potential ($V_{sig}$ or $V_{XCS}$) reflecting a gray level is written to the holding capacitor $\mathbf{22}_G$ under control of the control signal $GATE_{2G}$ for green.

The second switching transistor $\mathbf{232}_B$ has one of its main electrodes connected in common to the pixel electrode of the liquid crystal capacitor $\mathbf{21}_B$ and one of the electrodes of the holding capacitor $\mathbf{22}_B$. The second switching transistor $\mathbf{232}_B$ has its other main electrode connected to the other main electrode of the first switching transistor 231. The same transistor $\mathbf{232}_B$ goes into conduction when the signal potential ($V_{sig}$ or $V_{XCS}$) reflecting a gray level is written to the holding capacitor $\mathbf{22}_B$ under control of the control signal $GATE_{2B}$ for blue.

In the polarity inversion section $\mathbf{24}_A$, the inverter circuit 241 includes, for example, a CMOS inverter. More specifically, the inverter circuit 241 includes a P-channel MOS transistor $Q_{p1}$ and N-channel MOS transistor $Q_{n1}$ that are connected in series between the power lines of power supply potentials $V_{DD}$ and $V_{SS}$.

The gate electrodes of the P-channel MOS transistor $Q_{p1}$ and N-channel MOS transistor $Q_{n1}$ are connected together to serve as an input terminal of the inverter circuit 241. This input terminal is connected to the other main electrode of the third switching transistor 242. Further, the drain electrodes of the P-channel MOS transistor $Q_{p1}$ and N-channel MOS transistor $Q_{n1}$ are connected together to serve as an output terminal of the inverter circuit 241. This output terminal is connected to the other main electrode of the fourth switching transistor 243.

The inverter circuit 241 configured as described above inverts the polarity, i.e., logic level, of the potentials held by the holding capacitors $\mathbf{22}_R$, $\mathbf{22}_G$ and $\mathbf{22}_B$ during the refresh operation in memory display mode which will be described later.

The third switching transistor 242 has one of its main electrodes connected to the other main electrode of the first switching transistor 231 and its other main electrode to the input terminal of the inverter circuit 241 (i.e., gate electrodes of the P-channel MOS transistor $Q_{p1}$ and N-channel MOS transistor $Q_{n1}$). The same transistor 242 goes out of conduction when the signal potential ($V_{sig}$ or $V_{XCS}$) reflecting a gray level is written to the pixel 20 from the signal line 31 under control of a control signal $SR_1$.

Further, the third switching transistor 242 goes into conduction and remains in this state for a given period of time immediately prior to the end of each frame when the refresh operation is performed in memory display mode under control of the control signal $SR_1$. Incidentally, when the third switching transistor 242 conducts, the potentials held by the holding capacitors $\mathbf{22}_R$, $\mathbf{22}_G$ and $\mathbf{22}_B$ serving as a DRAM are read to the input terminal of the inverter circuit 241 via the third switching transistor 242.

The fourth switching transistor 243 has one of its main electrodes connected to the other main electrode of the first switching transistor 231 and its other main electrode to the output terminal of the inverter circuit 241 (i.e., drain electrodes of the P-channel MOS transistor $Q_{p1}$ and N-channel MOS transistor $Q_{n1}$). The same transistor 243 goes out of conduction when the signal potential ($V_{sig}$ or $V_{XCS}$) reflecting a gray level is written to the pixel 20 from the signal line 31 under control of a control signal $SR_2$.

Further, the fourth switching transistor 243 goes into conduction and remains in this state for a given period of time immediately after the start of each frame when the refresh operation is performed in memory display mode under control of the control signal $SR_2$. Incidentally, when the fourth switching transistor 243 conducts, the signal potential whose polarity (logic level) has been inverted by the inverter circuit 241 is written to the holding capacitors $\mathbf{22}_R$, $\mathbf{22}_G$ and $\mathbf{22}_B$ via the fourth switching transistor 243 and second switching transistors $\mathbf{232}_R$, $\mathbf{232}_G$ and $\mathbf{232}_B$.

Circuit Operation

A description will be given next of the operation of the pixel circuit according to the above example 1, i.e., the operation of the subpixels $\mathbf{20}_R$, $\mathbf{20}_G$ and $\mathbf{20}_B$ in each display mode.

(1) Analog Display Mode

FIGS. 8A to 8F are timing waveform diagrams for describing the operation of the pixel circuit according to example 1 in analog display mode. FIGS. 8A to 8F illustrate the waveforms of the potential of the signal line 31 and the control signal $GATE_1$, control signal $GATE_{2R}$ for red, control signal $GATE_{2G}$ for green, control signal $GATE_{2B}$ for blue and control signal $SR_1$ or $SR_2$, respectively.

In the present example, the polarity of the voltage applied between the pixel electrodes of the liquid crystal capacitors $\mathbf{21}_R$, $\mathbf{21}_G$ and $\mathbf{21}_B$ and the opposed electrode is inverted every horizontal period (1H/line) for driving purpose, that is, line inversion driving is performed. As is well known, in order to prevent deterioration of the specific resistance and other characteristics of the liquid crystal (inherent resistance of the substance) in a liquid crystal display device, AC driving is performed which is designed to invert the polarity of the voltage applied to the liquid crystal with respect to the common potential $V_{COM}$ at give intervals.

In the present embodiment, line inversion driving is performed as this AC driving. In order to perform this line inversion driving, the polarity of the signal potential reflecting a gray level, i.e., the potential of the signal line 31, is inverted every horizontal period as illustrated in FIG. 8A. In the waveform shown in FIG. 8A, the high level potential is $V_{DD1}$, and the low level potential is $V_{SS1}$. Further, FIG. 8A illustrates a case in which the amplitude is maximal ranging from $V_{DD1}$ to $V_{SS1}$. In reality, the potential of the signal line 31 assumes a level falling within the range from $V_{DD1}$ to $V_{SS1}$ according to the gray level.

In FIG. 8B illustrating the waveform of the control signal $GATE_1$, the high level potential is $V_{DD2}$, and the low level potential is $V_{SS2}$. The control signal $GATE_1$ rises to the high level potential $V_{DD2}$ and remains at this level during the write period in which the signal potential reflecting a gray level is written to the holding capacitors $\mathbf{22}_R$, $\mathbf{22}_G$ and $\mathbf{22}_B$ from the signal line 31.

Also in FIGS. 8C, 8D and 8E illustrating the waveforms of the control signals $GATE_{2R}$, $GATE_{2G}$ and $GATE_{2B}$, the high level potential is $V_{DD2}$, and the low level potential is $V_{SS2}$. The control signals $GATE_{2R}$, $GATE_{2G}$ and $GATE_{2G}$ rise to the high level potential $V_{DD2}$, for example, in the sequence of red, green and blue during the write period in which the signal potential reflecting a gray level is written to the holding capacitors $\mathbf{22}_R$, $\mathbf{22}_G$ and $\mathbf{22}_B$ from the signal line 31, i.e., during the period of time in which the control signal $GATE_1$ is at the high level potential $V_{DD2}$.

It should be noted that the periods of time in which the control signals $GATE_{2R}$, $GATE_{2G}$ and $GATE_{2B}$ remain at the high level potential $V_{DD2}$ do not overlap with each other. Further, the signal potentials $V_{sig}$ reflecting a gray level for the respective colors are output to the signal line 31 from the signal line drive section 40 shown in FIG. 1 respectively during the periods of time in which the control signals $GATE_{2R}$, $GATE_{2G}$ and $GATE_{2B}$ remain at the high level potential $V_{DD2}$.

Also in FIG. 8F illustrating the waveform of the control signal $SR_1$ or $SR_2$, the high level potential is $V_{DD2}$, and the low level potential is $V_{SS2}$. The control signal $SR_1$ or $SR_2$ is typically at the low level potential $V_{SS2}$ in analog display mode.

(2) Memory Display Mode

In memory display mode, the write operation and refresh operation are performed. The write operation writes the signal potential reflecting a gray level to the holding capacitors $\mathbf{22}_R$, $\mathbf{22}_G$ and $\mathbf{22}_B$ from the signal line 31. The refresh operation refreshes the potentials held by the holding capacitors $\mathbf{22}_R$, $\mathbf{22}_G$ and $\mathbf{22}_B$. Of these, the write operation is performed, for example, to change the content of information to be displayed. It should be noted that the write operation adapted to write the signal potential reflecting a gray level to the holding capacitors $\mathbf{22}_R$, $\mathbf{22}_G$ and $\mathbf{22}_B$ from the signal line 31 is the same as in analog display mode. Therefore, the description thereof is omitted.

FIGS. 9A to 9H are timing waveform diagrams for describing the refresh operation performed by the pixel circuit according to example 1 in memory display mode, illustrating the relationship for driving on a frame-by-frame (1F) basis.

FIGS. 9A to 9E illustrate the waveforms of the control signals $GATE_{2R}$, $GATE_{2G}$, $GATE_{2B}$ and $SR_1$ or $SR_2$ and the CS potential $V_{CS}$, respectively. Further, FIGS. 9F to 9H illustrate the waveforms of the signal potentials $PIX_R$, $PIX_G$ and $PIX_B$ written to the holding capacitors $\mathbf{22}_R$, $\mathbf{22}_G$ and $\mathbf{22}_B$, respectively.

As is clear from the timing waveform diagrams shown in FIGS. 9A to 9H, a high level potential of each of the control signals $GATE_{2R}$, $GATE_{2G}$ and $GATE_{2B}$ is generated in the form of a pulse every three frames. In contrast, a high level potential of the control signal $SR_1$ or $SR_2$ is generated in the form of a pulse every frame. The CS potential $V_{CS}$ alternates between high and low level potentials every frame.

Figure 9A:
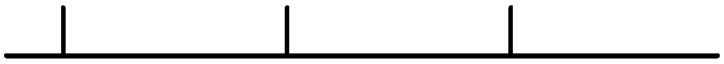
FIGS. 9A to 9H are timing waveform diagrams for describing the refresh operation performed by the pixel circuit according to example 1 in memory display mode.
Figure 9B:
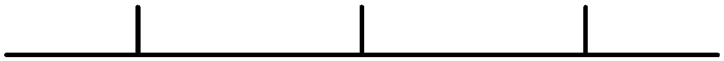
Figure 9C:
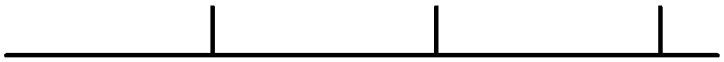
Figure 9D:
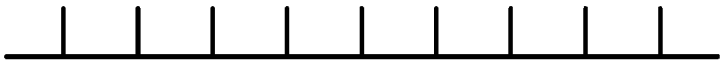
Figure 9E:
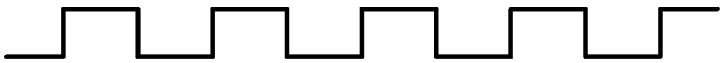
Figure 9F:
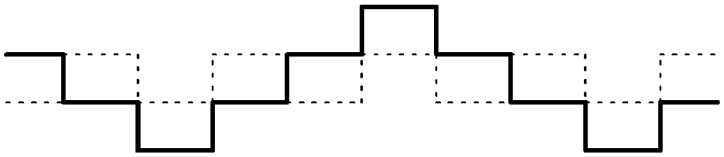
Figure 9G:
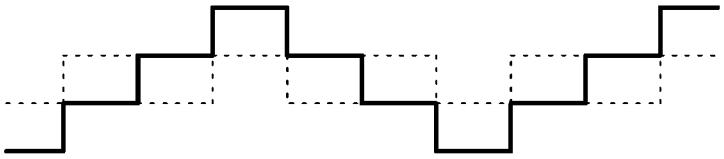
Figure 9H:
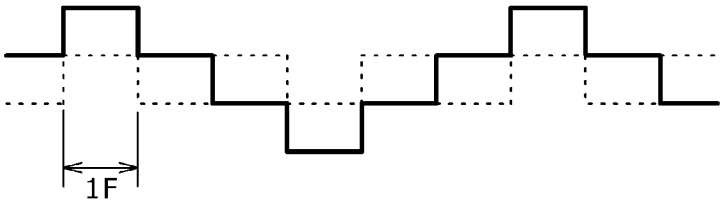
Figures 10A, 10B, 10C, 10D:
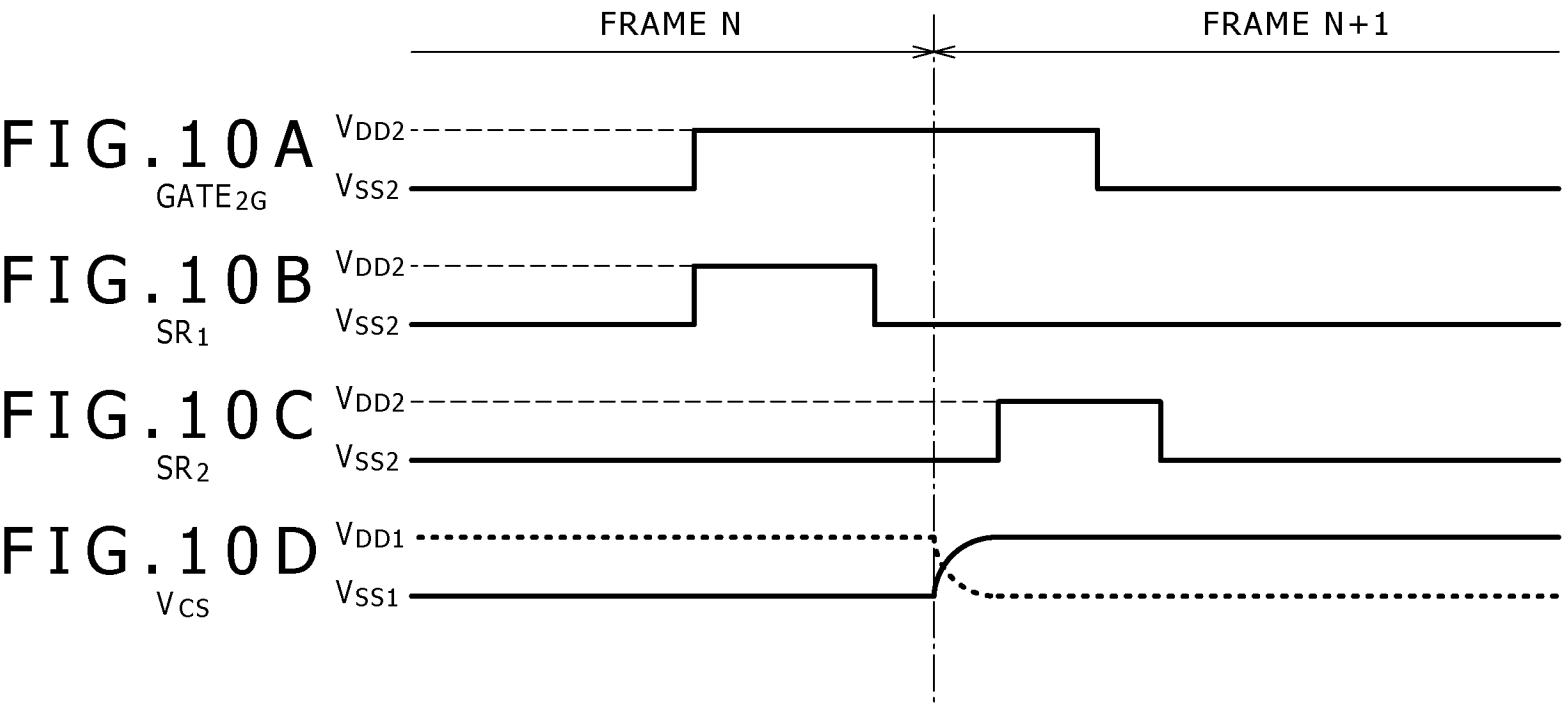
FIGS. 10A to 10D are timing waveform diagrams for describing the operation of a scan line in the pixel circuit according to example 1 in memory display mode.

In FIGS. 9F, 9G and 9H, on the other hand, the waveforms of the CS potential $V_{CS}$ are shown by dotted lines, and the waveforms of the signal potentials $PIX_R$, $PIX_G$ and $PIX_B$ reflecting a gray level are shown by solid lines. The signal potentials $PIX_R$, $PIX_G$ and $PIX_B$ reflecting a gray level change every frame with change in the CS potential $V_{CS}$ every frame. The potential relationship between the CS potential $V_{CS}$ and the signal potentials $PIX_R$, $PIX_G$ and $PIX_B$ change every three frames.

That is, the potentials $PIX_R$, $PIX_G$ and $PIX_B$ held by the holding capacitors $\mathbf{22}_R$, $\mathbf{22}_G$ and $\mathbf{22}_B$ for the respective colors are inverted in polarity and refreshed every three frames. Naturally, the potential relationship between the signal potentials $PIX_R$, $PIX_G$ and $PIX_B$ is maintained from the previous polarity inversion and refresh operation to the current polarity inversion and refresh operation. In the present example, therefore, it is desirable for the holding capacitors $\mathbf{22}_R$, $\mathbf{22}_G$ and $\mathbf{22}_B$ to have capacitances large enough to hold the signal potentials $PIX_R$, $PIX_G$ and $PIX_B$ reflecting a gray level even if the refresh rate is once every three frames.

It should be noted that the control signal $GATE_1$ is typically at the low level potential in memory display mode. As a result, the first switching transistor 231 goes out of conduction (a closed switch state), electrically isolating each of the subpixels $\mathbf{20}_R$, $\mathbf{20}_G$ and $\mathbf{20}_B$ from the signal line 31.

A detailed description will be given next of the operation within a frame. FIGS. 10A to 10D are timing waveform diagrams for describing the operation of a scan line in memory display mode. Here, a description will be given of the operation of the subpixel $\mathbf{20}_G$ for green (G) as an example. However, the subpixels $\mathbf{20}_R$ and $\mathbf{20}_B$ for other colors operate in the same manner.

FIGS. 10A to 10D illustrate the waveforms of the control signals $GATE_{2G}$, $SR_1$ and $SR_2$ and the CS potential Vcs in an enlarged manner at the boundary between frames, respectively. It should be noted that the current frame is denoted by reference symbol N, and the next frame by reference symbol N+1 in FIGS. 10A to 10D.

The control signal $GATE_{2G}$ adapted to bring the second switching transistor $\mathbf{232}_G$ into and out of conduction remains at the high level potential $V_{DD2}$ for a given period of time from immediately prior to the end of the current frame N to immediately after the start of the next frame N+1. The control signal $SR_1$ adapted to bring the third switching transistor 242 into and out of conduction remains at the high level potential $V_{DD2}$ for a given period of time immediately prior to the end of every frame. The control signal $SR_2$ adapted to bring the fourth switching transistor 243 into and out of conduction remains at the high level potential $V_{DD2}$ for a given period of time immediately after the start of every frame.

At the boundary between frames where the second switching element $232_G$ goes into conduction as a result of the control signal $GATE_{2G}$ rising to the high level potential $V_{DD2}$, the third switching transistor 242 goes into conduction as a result of the control signal $SR_1$ rising to the high level potential $V_{DD2}$ first. As a result, the potential $PIX_G$ held by the holding capacitor $22_G$ is read via the second and third switching transistors $232_G$ and 242 and supplied to the input terminal of the inverter circuit 241.

The inverter circuit 241 inverts the polarity (logic level) of the held potential $PIX_G$ read from the holding capacitor $22_G$. As a result of this action of the inverter circuit 241, the input potential at the high level potential VDD1 is inverted to the low level potential $V_{SS1}$ at the output.

In the next frame N+1, the fourth switching transistor 243 goes into conduction as a result of the control signal $SR_2$ rising to the high level potential $V_{DD2}$. This allows for the signal potential whose polarity (logic level) has been inverted by the inverter circuit 241, i.e., the output potential of the inverter circuit 241, to be written to the holding capacitor $22_G$ via the fourth and second switching transistors 243 and $232_G$. As a result, the polarity of the potential $PIX_G$ held by the holding capacitor $22_G$ is inverted. This series of operations allows for the potential $PIX_G$ held by the holding capacitor $22_G$ to be inverted in polarity and refreshed.

Then, the signal line 31 having a large load capacitance is not charged or discharged in the refresh operation. In other words, the potential $PIX_G$ held by the holding capacitor $22_G$ can be inverted in polarity and refreshed without charging or discharging the signal line 31 having a large load capacitance thanks to the action of the inverter circuit 241 and switching transistors 231, $232_G$, 242 and 243.

The above polarity inversion and refresh operation of the potential $PIX_G$ held by the holding capacitor $22_G$ are repeated every three frames in memory display mode. Here, a description has been given of the polarity inversion and refresh operation performed on the subpixel $20_G$. However, the above operations are performed in sequence on the subpixel $20_R$ for red, the subpixel $20_G$ for green and the subpixel $20_B$ for blue every frame. It should be noted that the order is arbitrary.

The pixel circuit according to example 1 described above provides a liquid crystal display device capable of functioning both in analog display mode and in memory display mode. Moreover, the holding capacitors $22_R$, $22_G$ and $22_B$ are used as a DRAM in memory display mode, thus contributing to simpler pixel structure than if an SRAM is used as a memory. As a result, this pixel circuit is more advantageous than that using an SRAM as a memory in terms of downsizing of the pixel 20.

Further, it is basically not necessary to electrically connect the pixel 20 and signal line 31 in memory display mode. That is, the potentials $PIX_R$, $PIX_G$ and $PIX_B$ held by the holding capacitors $22_R$, $22_G$ and $22_B$ can be refreshed without charging or discharging the signal line 31 having a large load capacitance. This provides even lower power consumption in memory display mode.

Still further, the pixel circuit according to example 1 provides the following function and effect by turning OFF the last second switching transistor $232_B$ first and then turning OFF the first switching transistor 231.

That is, the condition affecting the plurality of subpixels $20_R$, $20_G$ and $20_B$ due to coupling through parasitic capacitance present at the control electrodes of the second switching transistors $232_R$, $232_G$ and $232_B$ is the same for these subpixels during the OFF period of any of these second switching transistors. This makes it possible for the holding capacitors $22_R$, $22_G$ and $22_B$ of the subpixels $20_R$, $20_G$ and $20_B$ to hold desired signal potentials, thus avoiding the unbalance between the colors due to coupling through parasitic capacitance.

In the case of the pixel circuit according to example 1 using the inverter circuit 241 as the polarity inversion section $24_A$, the inverter circuit 241 including, for example, the two MOS transistors $Q_{p1}$ and $Q_{n1}$ is extremely simple in structure, thus contributing to simpler pixel structure. As a result, this pixel circuit is more advantageous than that using an SRAM as a memory in terms of downsizing of the pixel 20.

2-2. Example 2

Figure 11:
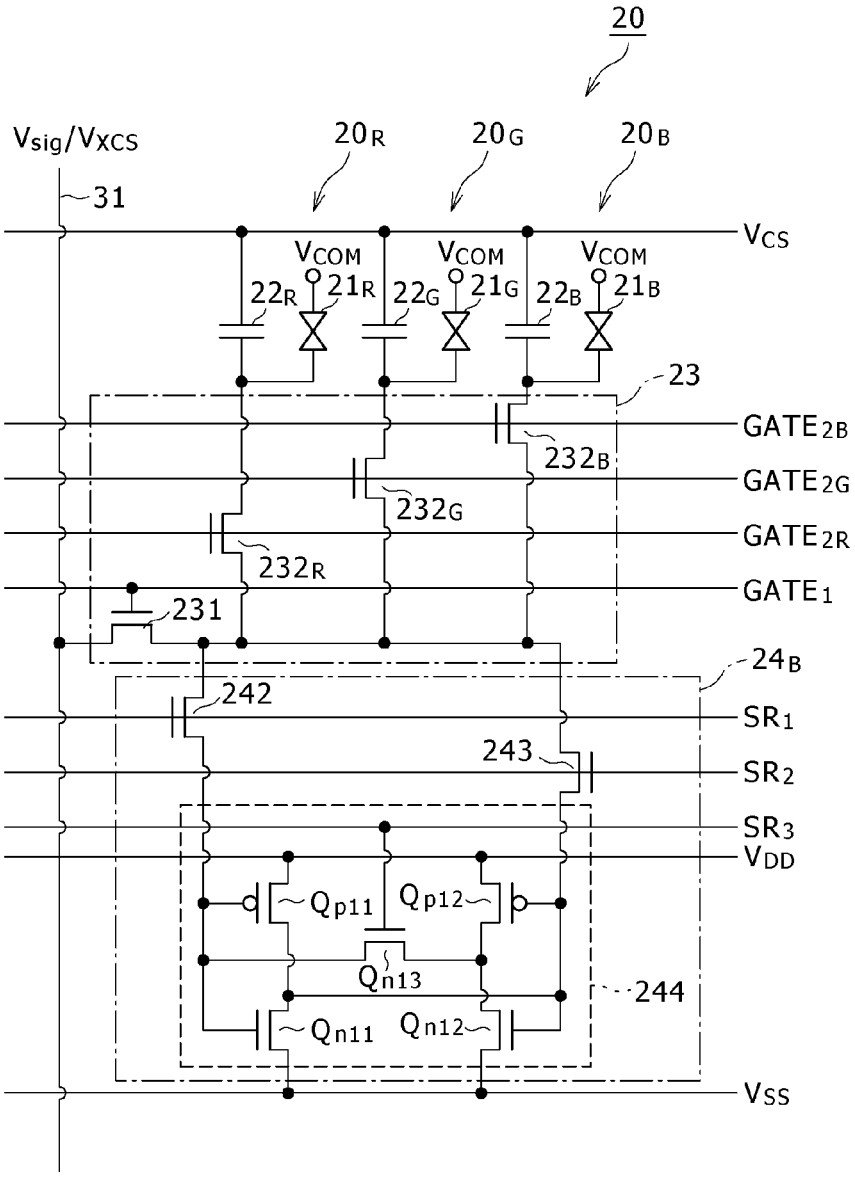
FIG. 11 is a circuit diagram illustrating the pixel circuit according to example 2.

FIG. 11 is a circuit diagram illustrating the pixel circuit according to example 2. In FIG. 11, like components to those shown in FIG. 7 are designated by the same reference symbols.

In the pixel circuit according to example 2, a polarity inversion section $24_B$ includes a latch circuit 244 and the third switching element 242 and fourth switching element 243. In the present example 2, thin film transistors are, for example, also used as the switching transistors 231, $232_R$, $232_G$, $232_B$, 242 and 243 that are switching elements. On the other hand, although N-channel MOS transistors are used as the switching transistors 231, $232_R$, $232_G$, $232_B$, 242 and 243, P-channel MOS transistors may also be used instead.

Circuit Configuration

In FIG. 11, the selector section 23 has exactly the same circuit configuration as that according to example 1. That is, the first switching transistor 231 has one of its main electrodes (drain or source electrode) connected to the signal line 31. The same transistor 231 goes into conduction when the signal potential ($V_{sig}$ or $V_{XCS}$) reflecting a gray level is written to (loaded into) the pixel 20 from the signal line 31 under control of the control signal $GATE_1$.

The second switching transistor $232_R$ has one of its main electrodes connected in common to the pixel electrode of the liquid crystal capacitor $21_R$ and one of the electrodes of the holding capacitor $22_R$. The second switching transistor $232_R$ has its other main electrode connected to the other main electrode of the first switching transistor 231. The same transistor $232_R$ goes into conduction when the signal potential ($V_{sig}$ or $V_{XCS}$) reflecting a gray level is written to the holding capacitor $22_R$ under control of the control signal $GATE_{2R}$ for red.

The second switching transistor $232_G$ has one of its main electrodes connected in common to the pixel electrode of the liquid crystal capacitor $21_G$ and one of the electrodes of the holding capacitor $22_G$. The second switching transistor $232_G$ has its other main electrode connected to the other main electrode of the first switching transistor 231. The same transistor $232_G$ goes into conduction when the signal potential ($V_{sig}$ or $V_{XCS}$) reflecting a gray level is written to the holding capacitor $22_G$ under control of the control signal $GATE_{2G}$ for green.

The second switching transistor $232_B$ has one of its main electrodes connected in common to the pixel electrode of the liquid crystal capacitor $21_B$ and one of the electrodes of the holding capacitor $22_B$. The second switching transistor $232_B$ has its other main electrode connected to the other main electrode of the first switching transistor 231. The same transistor $232_B$ goes into conduction when the signal potential ($V_{sig}$ or $V_{XCS}$) reflecting a gray level is written to the holding capacitor $22_B$ under control of the control signal $GATE_{2B}$ for blue.

In the polarity inversion section $24_B$, the latch circuit 244 includes, for example, two CMOS inverters. More specifically, one of the CMOS inverters includes a P-channel MOS transistor $Q_{p11}$ and N-channel MOS transistor $Q_{n11}$ that are connected in series between the power lines of the power supply potentials $V_{DD}$ and $V_{SS}$. The other CMOS inverter similarly includes a P-channel MOS transistor $Q_{p12}$ and N-channel MOS transistor $Q_{n12}$ that are connected in series between the power lines of the power supply potentials $V_{DD}$ and $V_{SS}$.

The gate electrodes of the P-channel MOS transistor $Q_{p11}$ and N-channel MOS transistor $Q_{n11}$ are connected together to serve as an input terminal of the latch circuit 244. This input terminal is connected to the other main electrode of the third switching transistor 242. The gate electrodes of the P-channel MOS transistor $Q_{p12}$ and N-channel MOS transistor $Q_{n12}$ are connected together to serve as an output terminal of the latch circuit 244. This output terminal is connected to the other main electrode of the fourth switching transistor 243.

Further, the gate electrodes of the P-channel MOS transistor $Q_{p11}$ and N-channel MOS transistor $Q_{n11}$ are connected to the drain electrodes of the P-channel MOS transistor $Q_{p12}$ and N-channel MOS transistor $Q_{n12}$ via a control transistor $Q_{n13}$. The gate electrodes of the P-channel MOS transistor $Q_{p12}$ and N-channel MOS transistor $Q_{n12}$ are connected directly to the drain electrodes of the P-channel MOS transistor $Q_{p11}$ and N-channel MOS transistor $Q_{n11}$.

The control transistor $Q_{n13}$ selectively activates the latch circuit 244 under control of a control signal $SR_3$ during the refresh operation in memory display mode. More specifically, when the control transistor $Q_{n13}$ conducts, the latch circuit 244 including two CMOS inverters is activated. The potentials held by the holding capacitors $\mathbf{22}_R$, $\mathbf{22}_G$ and $\mathbf{22}_B$ are inverted in polarity and refreshed by the activation of the latch circuit 244. On the other hand, when the control transistor $Q_{n13}$ does not conduct, the two inverters each serve as an independent amplifying circuit.

The third switching transistor 242 has one of its main electrodes connected to the other main electrode of the first switching transistor 231 and its other main electrode to the input terminal of the latch circuit 244 (i.e., gate electrodes of the MOS transistors $Q_{p11}$ and $Q_{n11}$). The same transistor 242 goes out of conduction when the signal potential ($V_{sig}$ or $V_{XCS}$) reflecting a gray level is written to the pixel 20 from the signal line 31 under control of the control signal $SR_1$.

Further, the third switching transistor 242 goes into conduction and remains in this state for a given period of time immediately prior to the end of each frame when the refresh operation is performed in memory display mode under control of the control signal $SR_1$. Incidentally, when the third switching transistor 242 conducts, the potentials held by the holding capacitors $\mathbf{22}_R$, $\mathbf{22}_G$ and $\mathbf{22}_B$ serving as a DRAM are read to the input terminal of the latch circuit 244 via the third switching transistor 242.

The fourth switching transistor 243 has one of its main electrodes connected to the other main electrode of the first switching transistor 231 and its other main electrode to the output terminal of the latch circuit 244 (i.e., gate electrodes of the MOS transistors $Q_{p12}$ and $Q_{n12}$). The same transistor 243 goes out of conduction when the signal potential ($V_{sig}$ or $V_{XCS}$) reflecting a gray level is written to the pixel 20 from the signal line 31 under control of the control signal $SR_2$.

Further, the fourth switching transistor 243 goes into conduction and remains in this state for a given period of time immediately after the start of each frame when the refresh operation is performed in memory display mode under control of the control signal $SR_2$. Incidentally, when the fourth switching transistor 243 conducts, the signal potential whose polarity (logic level) has been inverted by the latch circuit 244 is written to the holding capacitors $\mathbf{22}_R$, $\mathbf{22}_G$ and $\mathbf{22}_B$ via the fourth switching transistor 243 and second switching transistors $\mathbf{232}_R$, $\mathbf{232}_G$ and $\mathbf{232}_B$.

Circuit Operation

A description will be given next of the operation of the pixel circuit according to the above example 2, i.e., the operation of the subpixels $\mathbf{20}_R$, $\mathbf{20}_G$ and $\mathbf{20}_B$ in each display mode.

(1) Analog Display Mode

FIGS. 12A to 12G are timing waveform diagrams for describing the operation of the pixel circuit according to example 2 in analog display mode. FIGS. 12A to 12G illustrate the waveforms of the potential of the signal line 31, the control signal $GATE_1$, control signal $GATE_{2R}$ for red, control signal $GATE_{2G}$ for green, control signal $GATE_{2B}$ for blue, control signal $SR_1$ or $SR_2$ and control signal $SR_3$, respectively.

In the present example, the polarity of the voltage applied between the pixel electrodes of the liquid crystal capacitors $\mathbf{21}_R$, $\mathbf{21}_G$ and $\mathbf{21}_B$ and the opposed electrode is inverted every horizontal period (1H/line) for driving purpose, that is, line inversion driving (AC driving) is performed. In order to perform this line inversion driving, the polarity of the signal potential reflecting a gray level, i.e., the potential of the signal line 31, is inverted every horizontal period as illustrated in FIG. 12A.

Figures 12A, 12B, 12C, 12D, 12E, 12F, 12G:
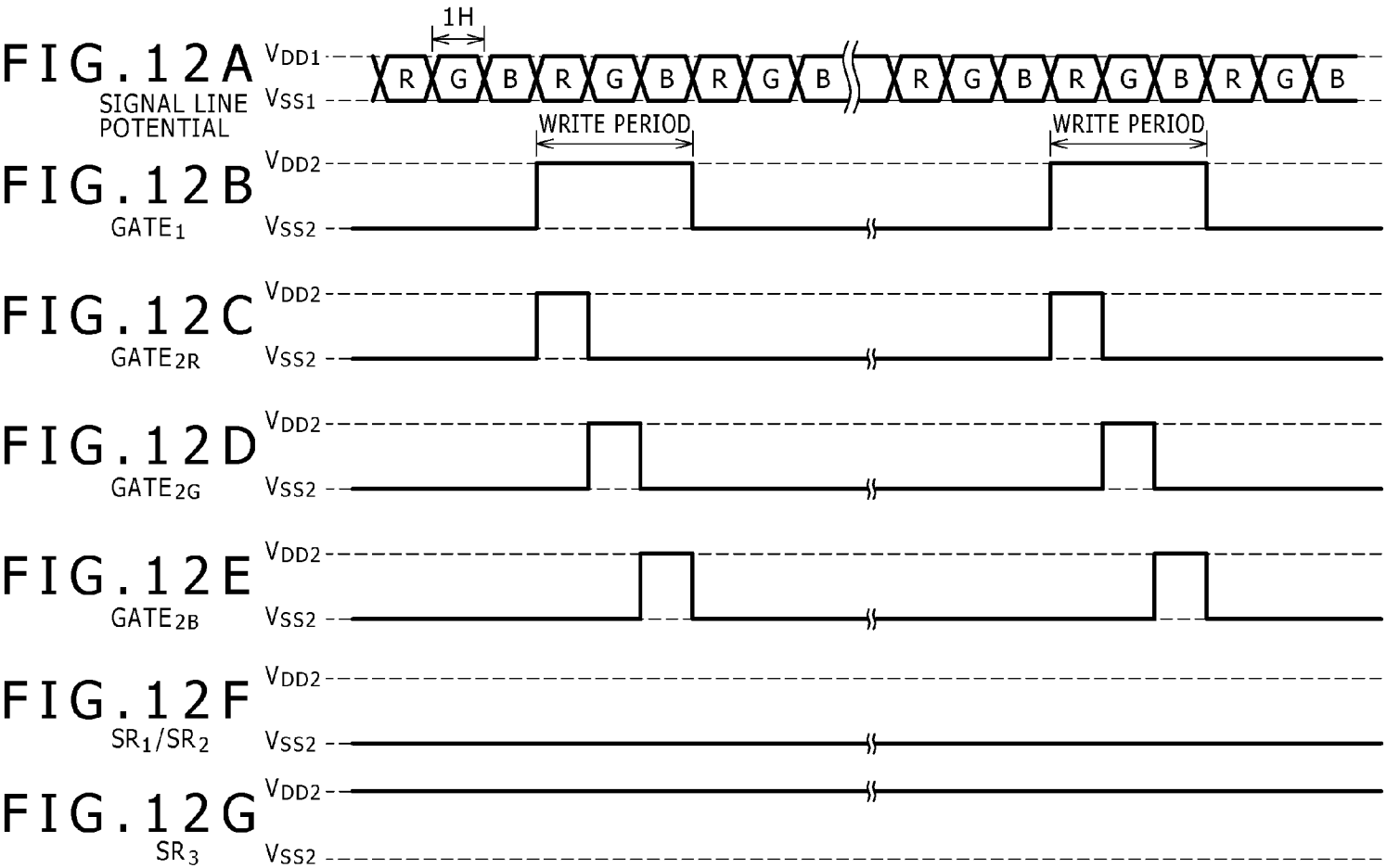
FIGS. 12A to 12G are timing waveform diagrams for describing the operation of the pixel circuit according to example 2 in analog display mode.

In the waveform of the signal potential reflecting a gray level illustrated in FIG. 12A, the high level potential is $V_{DD1}$, and the low level potential is $V_{SS1}$. Further, FIG. 12A illustrates a case in which the amplitude is maximal ranging from $V_{DD1}$ to $V_{SS1}$. In reality, the potential of the signal line 31 assumes a level falling within the range from $V_{DD1}$ to $V_{SS1}$ according to the gray level.

In FIG. 12B illustrating the waveform of the control signal $GATE_1$, the high level potential is $V_{DD2}$, and the low level potential is $V_{SS2}$. The control signal $GATE_1$ rises to the high level potential $V_{DD2}$ and remains at this level during the write period in which the signal potential reflecting a gray level is written to the holding capacitors $\mathbf{22}_R$, $\mathbf{22}_G$ and $\mathbf{22}_B$ from the signal line 31.

Also in FIGS. 12C, 12D and 12E illustrating the waveforms of the control signals $GATE_{2R}$, $GATE_{2G}$ and $GATE_{2B}$, the high level potential is $V_{DD2}$, and the low level potential is $V_{SS2}$. The control signals $GATE_{2R}$, $GATE_{2G}$ and $GATE_{2B}$ rise to the high level potential $V_{DD2}$, for example, in the sequence of red, green and blue during the write period in which the signal potential reflecting a gray level is written to the holding capacitors $\mathbf{22}_R$, $\mathbf{22}_G$ and $\mathbf{22}_B$ from the signal line 31, i.e., during the period of time in which the control signal $GATE_1$ is at the high level potential $V_{DD2}$.

It should be noted that the periods of time in which the control signals $GATE_{2R}$, $GATE_{2G}$ and $GATE_{2B}$ remain at the high level potential $V_{DD2}$ do not overlap with each other. Further, the signal potentials $V_{sig}$ reflecting a gray level for the respective colors are output to the signal line 31 from the signal line drive section 40 shown in FIG. 1 respectively during the periods of time in which the control signals $GATE_{2R}$, $GATE_{2G}$ and $GATE_{2B}$ remain at the high level potential $V_{DD2}$.

Also in FIGS. 12F and 12G illustrating the waveforms of the control signals $SR_1$ or $SR_2$ and $SR_3$, the high level potential is $V_{DD2}$, and the low level potential is $V_{SS2}$. In analog display mode, the control signal $SR_1$ or $SR_2$ is typically at the low level potential $V_{SS2}$, and the control signal $SR_3$ is typically at the high level potential $V_{DD2}$.

(2) Memory Display Mode

In memory display mode, the write operation and refresh operation are performed. The write operation writes the signal potential reflecting a gray level to the holding capacitors $22_R$, $22_G$ and $22_B$ from the signal line 31. The refresh operation refreshes the potentials held by the holding capacitors $22_R$, $22_G$ and $22_B$. Of these, the write operation is performed, for example, to change the content of information to be displayed. It should be noted that the write operation adapted to write the signal potential reflecting a gray level to the holding capacitors $22_R$, $22_G$ and $22_B$ from the signal line 31 is the same as in analog display mode. Therefore, the description thereof is omitted.

FIGS. 13A to 13I are timing waveform diagrams for describing the refresh operation performed by the pixel circuit according to example 2 in memory display mode, illustrating the relationship for driving on a frame-by-frame (1F) basis.

FIGS. 13A to 13F illustrate the waveforms of the control signals $GATE_{2R}$, $GATE_{2G}$, $GATE_{2B}$, $SR_1$ or $SR_2$ and $SR_3$ and the CS potential $V_{CS}$, respectively. Further, FIGS. 13G to 13I illustrate the waveforms of the signal potentials $PIX_R$, $PIX_G$ and $PIX_B$ written to the holding capacitors $22_R$, $22_G$ and $22_B$, respectively.

As is clear from the timing waveform diagrams shown in FIGS. 13A to 13I, a high level potential of each of the control signals $GATE_{2R}$, $GATE_{2G}$ and $GATE_{2B}$ is generated in the form of a pulse every three frames. In contrast, a high level potential of the control signal $SR_1$ or $SR_2$ is generated in the form of a pulse every frame. A low level potential of the control signal $SR_3$ is generated in the form of a pulse every frame. The CS potential $V_{CS}$ alternates between high and low level potentials every frame.

Figures 13A, 13B, 13C, 13D, 13E, 13F, 13G, 13H, 13I:
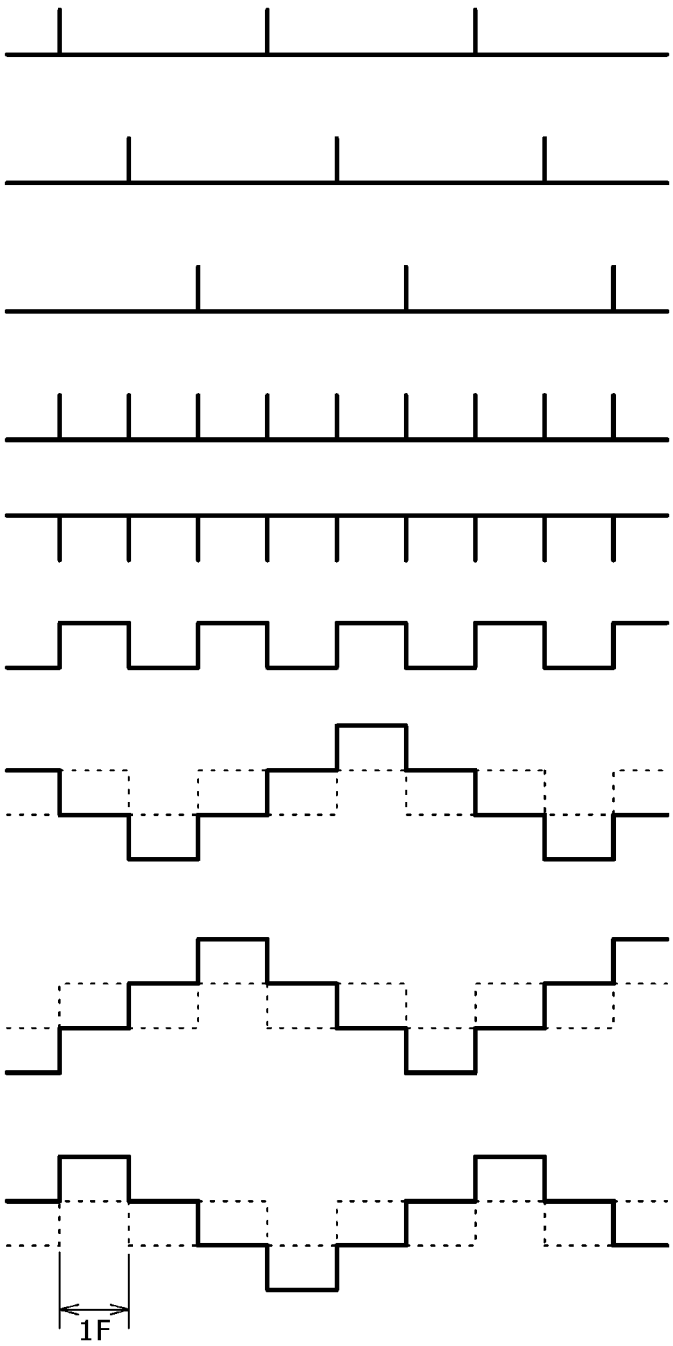
FIGS. 13A to 13I are timing waveform diagrams for describing the refresh operation according to example 2 in memory display mode.
Figures 14A, 14B, 14C, 14D, 14E:
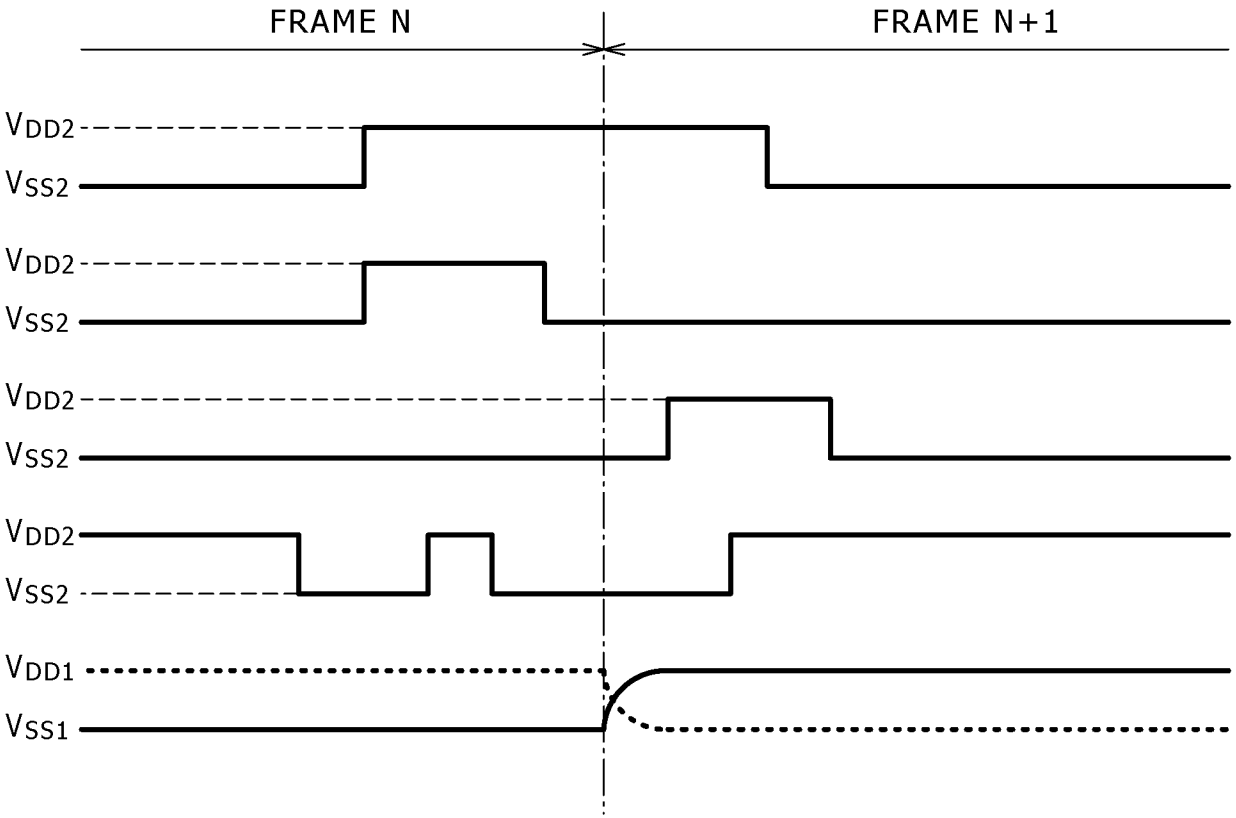
FIGS. 14A to 14E are timing waveform diagrams for describing the operation of a scan line in the pixel circuit according to example 2 in memory display mode.

In FIGS. 13G, 13H and 13I on the other hand, the waveforms of the CS potential $V_{CS}$ are shown by dotted lines, and the waveforms of the signal potentials $PIX_R$, $PIX_G$ and $PIX_B$ reflecting a gray level are shown by solid lines. The signal potentials $PIX_R$, $PIX_G$ and $PIX_B$ reflecting a gray level change every frame with change in the CS potential $V_{CS}$ every frame. The potential relationship between the CS potential $V_{CS}$ and the signal potentials $PIX_R$, $PIX_G$ and $PIX_B$ change every three frames.

That is, the potentials $PIX_R$, $PIX_G$ and $PIX_B$ held by the holding capacitors $22_R$, $22_G$ and $22_B$ for the respective colors are inverted in polarity and refreshed every three frames. Naturally, the potential relationship between the signal potentials $PIX_R$, $PIX_G$ and $PIX_B$ is maintained from the previous polarity inversion and refresh operation to the current polarity inversion and refresh operation. In the present example, therefore, it is desirable for the holding capacitors $22_R$, $22_G$ and $22_B$ to have capacitances large enough to hold the signal potentials $PIX_R$, $PIX_G$ and $PIX_B$ reflecting a gray level even if the refresh rate is once every three frames.

It should be noted that the control signal $GATE_1$ is typically at the low level potential in memory display mode. As a result, the first switching transistor 231 goes out of conduction (a closed switch state), electrically isolating each of the subpixels $20_R$, $20_G$ and $20_B$ from the signal line 31.

A detailed description will be given next of the operation within a frame. FIGS. 14A to 14E are timing waveform diagrams for describing the operation of a scan line in memory display mode. Here, a description will be given of the operation of the subpixel $20_G$ for green (G) as an example. However, the subpixels $20_R$ and $20_B$ for other colors operate in the same manner.

FIGS. 14A to 14E illustrate the waveforms of the control signals $GATE_{2G}$, $SR_1$, $SR_2$ and $SR_3$, and CS potential Vcs in an enlarged manner at the boundary between frames, respectively. It should be noted that the current frame is denoted by reference symbol N, and the next frame by reference symbol N+1 in FIGS. 14A to 14E.

The control signal $GATE_{2G}$ adapted to bring the second switching transistor $232_G$ into and out of conduction remains at the high level potential $V_{DD2}$ for a given period of time from immediately prior to the end of the current frame N to immediately after the start of the next frame N+1. The control signal $SR_1$ adapted to bring the third switching transistor 242 into and out of conduction remains at the high level potential $V_{DD2}$ for a given period of time immediately prior to the end of every frame. The control signal $SR_2$ adapted to bring the fourth switching transistor 243 into and out of conduction remains at the high level potential $V_{DD2}$ for a given period of time immediately after the start of every frame.

The control signal $SR_3$ adapted to bring the control transistor $Q_{n13}$ of the latch circuit 244 into and out of conduction basically assumes the high level potential $V_{DD2}$. However, the control signal $SR_3$ falls to the low level potential $V_{SS2}$ immediately prior to the start of the reading of the signal potential $PIX_G$ reflecting a gray level from the holding capacitor $22_G$. When a given period of time elapses, the control signal $SR_3$ assumes the high level potential $V_{DD2}$ again. The control signal $SR_3$ is at the high level potential $V_{DD2}$ within the period of time in which the control signal $SR_1$ is at the high level potential $V_{DD2}$.

At the boundary between frames where the second switching element $232_G$ goes into conduction as a result of the control signal $GATE_{2G}$ rising to the high level potential $V_{DD2}$, the third switching transistor 242 goes into conduction as a result of the control signal $SR_1$ rising to the high level potential $V_{DD2}$ first. As a result, the potential $PIX_G$ held by the holding capacitor $22_G$ is read via the second and third switching transistors $232_G$ and 242 and supplied to the input terminal of the latch circuit 244.

The control signal $SR_3$ rises to the high level potential $V_{DD2}$ during the period of time in which the control signal $SR_1$ remains at the high level potential $V_{DD2}$, i.e., during the read period, thus bringing the control transistor $Q_{n13}$ into conduction and activating the latch circuit 244. That is, the latching function of the latch circuit 244 is enabled. This restores the potential $PIX_G$ held by the holding capacitor $22_G$ to its original signal potential. That is, the logic swing of the held potential $PIX_G$ is recovered. The refresh operation is designed to allow the held potential $PIX_G$ to recover its logic swing.

When the refresh operation ends, the control signal $SR_1$ falls again to the low level potential $V_{SS2}$, bringing the control transistor $Q_{n13}$ out of conduction. At this time, the signal potential $PIX_G$ reflecting a gray level that has been read from the holding capacitor $22_G$ during the current frame N, whose logic swing has been recovered and that has been inverted in logic level (polarity) by the latch circuit 244, appears at the input of the CMOS inverter including the MOS transistors $Q_{p12}$ and $Q_{n12}$.

In the next frame N+1, the control signal $SR_2$ rises to the high level potential $V_{DD2}$, bringing the fourth switching transistor 243 into conduction. As a result, the signal potential whose logic swing has been recovered and that has been inverted in logic level by the latch circuit 244, i.e., the output voltage of the latch circuit 244, is written to the holding capacitor $22_G$ via the fourth and second switching transistors 243 and $232_G$. This inverts the polarity of the potential $PIX_G$ held by the holding capacitor $22_G$. This series of operations allows for the potential $PIX_G$ held by the holding capacitor $22_G$ to be inverted in polarity and refreshed.

Then, the signal line 31 having a large load capacitance is not charged or discharged in the refresh operation. In other words, the potential $PIX_G$ held by the holding capacitor $\mathbf{22}_G$ can be inverted in polarity and refreshed without charging or discharging the signal line 31 having a large load capacitance thanks to the action of the latch circuit 244 and switching transistors 231, $\mathbf{232}_G$, 242 and 243.

The above polarity inversion and refresh operation of the potential $PIX_G$ held by the holding capacitor $\mathbf{22}_G$ are repeated every three frames in memory display mode. Here, a description has been given of the polarity inversion and refresh operation performed on the subpixel $\mathbf{20}_G$. However, the above operations are performed in sequence on the subpixel $\mathbf{20}_R$ for red, the subpixel $\mathbf{20}_G$ for green and the subpixel $\mathbf{20}_B$ for blue every frame. It should be noted that the order is arbitrary.

The pixel circuit according to example 2 described above provides the same function and effect as the pixel circuit according to example 1. That is, the holding capacitors $\mathbf{22}_R$, $\mathbf{22}_G$ and $\mathbf{22}_B$ are used as a DRAM in memory display mode, thus contributing to simpler pixel structure than if an SRAM is used as a memory. As a result, this pixel circuit is more advantageous than that using an SRAM as a memory in terms of downsizing of the pixel 20.

Further, it is basically not necessary to electrically connect the pixel 20 and signal line 31 in memory display mode. That is, the potentials $PIX_R$, $PIX_G$ and $PIX_B$ held by the holding capacitors $\mathbf{22}_R$, $\mathbf{22}_G$ and $\mathbf{22}_B$ can be refreshed without charging or discharging the signal line 31 having a large load capacitance. This provides even lower power consumption in memory display mode.

Still further, even the pixel circuit according to example 2 provides the following function and effect by turning OFF the last second switching transistor $\mathbf{232}_B$ first and then turning OFF the first switching transistor 231.

That is, the condition affecting the plurality of subpixels $\mathbf{20}_R$, $\mathbf{20}_G$ and $\mathbf{20}_B$ due to coupling through parasitic capacitance present at the gate electrodes of the second switching transistors $\mathbf{232}_R$, $\mathbf{232}_G$ and $\mathbf{232}_B$ is the same for these subpixels during the OFF period of any of these second switching transistors. This makes it possible for the holding capacitors $\mathbf{22}_R$, $\mathbf{22}_G$ and $\mathbf{22}_B$ of the subpixels $\mathbf{20}_R$, $\mathbf{20}_G$ and $\mathbf{20}_B$ to hold desired signal potentials, thus avoiding the unbalance between the colors due to coupling through parasitic capacitance.

Further, the pixel circuit according to example 2 using the latch circuit 244 as the polarity inversion section $\mathbf{24}_B$ is more advantageous than the pixel circuit according to example 1 using the inverter circuit 241 in that the signal potential whose polarity has been inverted can be held although the circuit configuration is slightly more complicated.

3. Modification Example

Cases have been described in the above embodiment in which the single polarity inversion section 24 ($\mathbf{24}_A$ or $\mathbf{24}_B$) is provided in common for the three subpixels $\mathbf{20}_R$, $\mathbf{20}_G$ and $\mathbf{20}_B$. However, this is merely an example, and the present application is applicable to display devices adopting the in-pixel selector driving method in general. Therefore, the polarity inversion section as described in the examples is not essential for the present application. Alternatively, the single polarity inversion section 24 may be shared, for example, among four or more pixels (subpixels).

More specifically, in a liquid crystal display device capable of color display, the single polarity inversion section 24 may be shared, for example, between two unit pixels, each made up of red, green and blue subpixels, i.e., among six subpixels. The more pixels (subpixels) there are that share the single polarity inversion section 24, the more circuit components making up the liquid crystal display panel $\mathbf{10}_A$ can be reduced, thus contributing to improved yield of the same panel $\mathbf{10}_A$.

4. Application Examples

The above liquid crystal display device according to the present application is applicable as a display device of pieces of electronic equipment used across all disciplines to display an image or video of a video signal fed to or generated inside the electronic equipment. For example, the liquid crystal display device is applicable as a display device of a variety of electronic equipment shown in FIGS. 15 to 19G including a digital camera, laptop personal computer, personal digital assistance such as mobile phone and video camcorder.

As described above, using the liquid crystal display device according to the present application as display devices of pieces of electronic equipment used across all disciplines contributes to higher definition of the display devices and reduced power consumption of the electronic equipment. That is, as is clear from the description of the embodiment, the liquid crystal display device according to the present application uses the holding capacitors in each pixel as a DRAM, thus contributing to simpler pixel structure and thereby allowing for downsizing of the pixel. Moreover, the color balance can be maintained by ensuring that the condition affecting a plurality of subpixels due to coupling through parasitic capacitance is the same for the subpixels when the in-pixel selector driving method is adopted. For the above reasons, the liquid crystal display device according to the present application contributes to higher definition and improved color reproducibility of the display devices of a variety of electronic equipment.

The liquid crystal display device according to the present application includes those sealed in the form of a module. For example, a display module corresponding to one of such display devices has a sealing section (not shown) around the pixel array section. The display module is formed by attaching an opposed section such as transparent glass using the sealing section as an adhesive. This transparent opposed section may include a color filter and protective film and further a light-shielding film. It should be noted that a circuit section or FPC (flexible printed circuit) may be provided for exchange of signals and other information between external equipment and the pixel array section.

A description will be given below of specific examples of electronic equipment to which the present application is applied.

Figure 15:
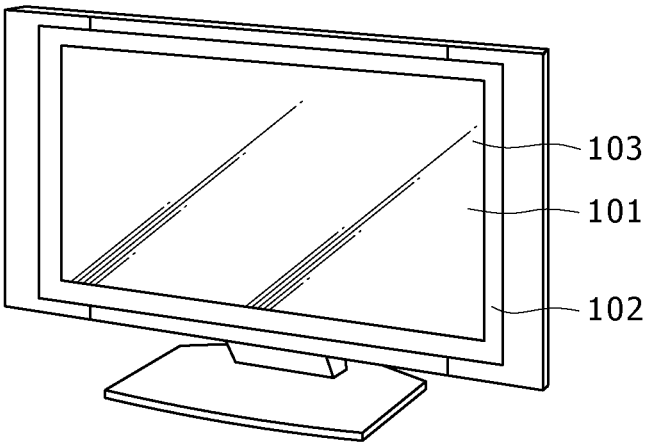
FIG. 15 is a perspective view illustrating the appearance of a television set to which the present application is applied.

FIG. 15 is a perspective view illustrating the appearance of a television set to which the present application is applied. The television set according to the present application example includes a video display screen section 101 made up of a front panel 102, filter glass 103 and other parts. The television set is manufactured by using the display device according to the present application as the video display screen section 101.

Figure 16A:
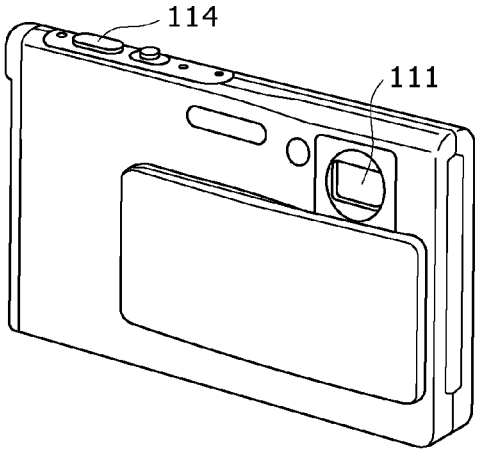
FIGS. 16A and 16B are perspective views illustrating the appearance of a digital camera to which the present application is applied.
Figure 16B:
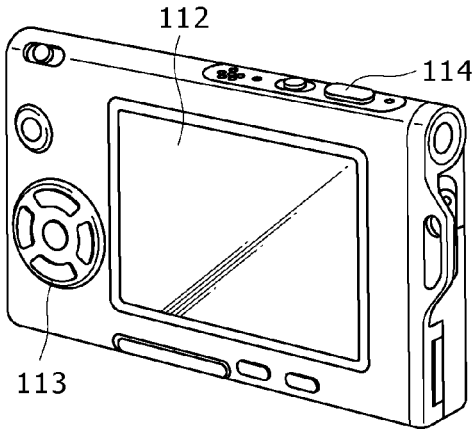

FIGS. 16A and 16B are perspective views illustrating the appearance of a digital camera to which the present application is applied. FIG. 16A is a front view, and FIG. 16B a rear view. The digital camera according to the present application example includes a flash-emitting section 111, display section 112, menu switch 113, shutter button 114 and other parts. The digital camera is manufactured by using the display device according to the present application as the display section 112.

Figure 17:
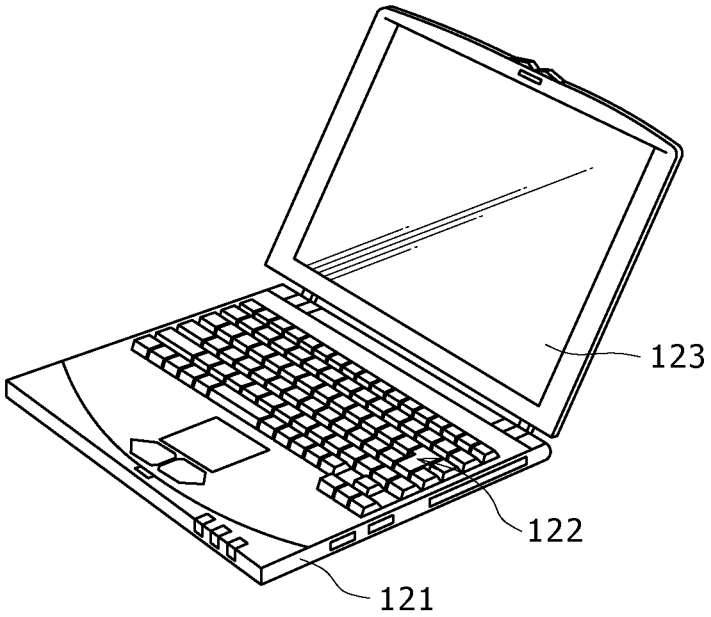
FIG. 17 is a perspective view illustrating the appearance of a laptop personal computer to which the present application is applied.

FIG. 17 is a perspective view illustrating the appearance of a laptop personal computer to which the present application is applied. The laptop personal computer according to the present application example includes a keyboard 122 adapted to be manipulated for entry of text or other information, a display section 123 adapted to display an image and other parts in a main body 121. The laptop personal computer is manufactured by using the display device according to the application as the display section 123.

Figure 18:
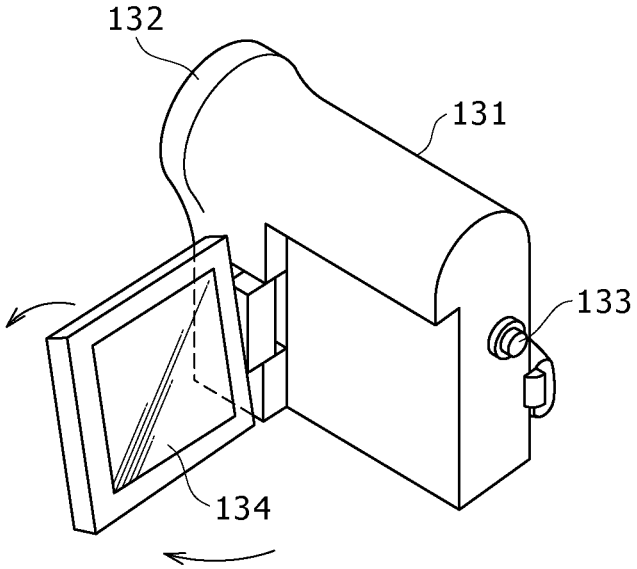
FIG. 18 is a perspective view illustrating the appearance of a video camcorder to which the present application is applied.

FIG. 18 is a perspective view illustrating a video camcorder to which the present application is applied. The video camcorder according to the present application example includes a main body section 131, lens 132 provided on the front-facing side surface to capture the image of the subject, imaging start/stop switch 133, display section 134 and other parts. The video camcorder is manufactured by using the display device according to the present application as the display section 134.

Figure 19A:
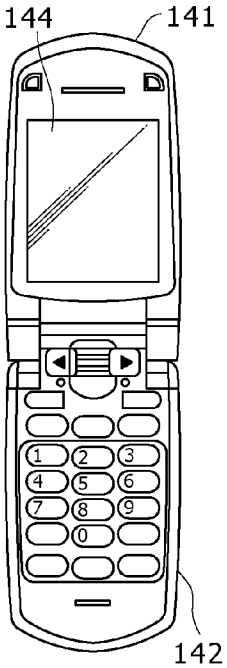
FIGS. 19A to 19G are external views of a mobile phone to which the present application is applied.
Figure 19B:
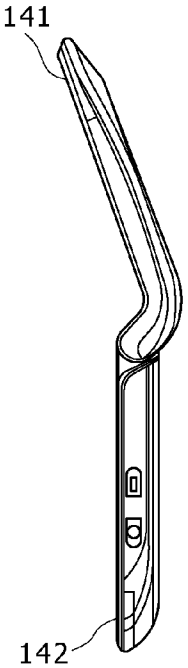
Figure 19D:
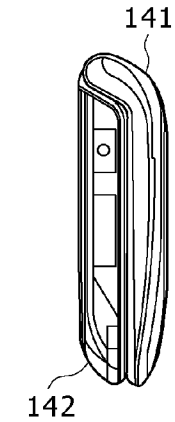
Figure 19C:
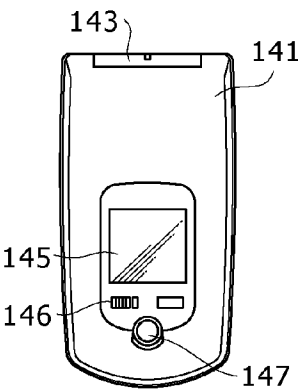
Figure 19E:
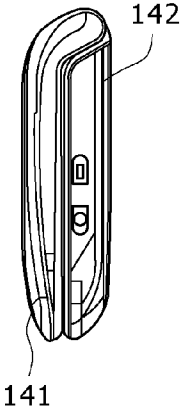
Figure 19F:
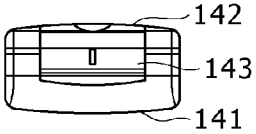
Figure 19G:
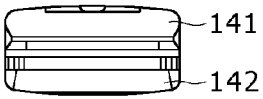

FIGS. 19A to 19G are views illustrating the appearance of a personal digital assistance such as mobile phone to which the present application is applied. FIG. 19A is a front view in an open position, FIG. 19B a side view thereof, FIG. 19C a front view in a closed position, FIG. 19D a left side view, FIG. 19E a right side view, FIG. 19F a top view, and FIG. 19G a bottom view. The mobile phone according to the present application example includes an upper enclosure 141, lower enclosure 142, connecting section (hinge section in this example) 143, display 144, subdisplay 145, picture light 146, camera 147 and other parts. The mobile phone according to the present application example is manufactured by using the display device according to the present application as the display 144 and subdisplay 145.

It should be understood that various changes and modifications to the presently preferred embodiments described herein will be apparent to those skilled in the art. Such changes and modifications can be made without departing from the spirit and scope and without diminishing its intended advantages. It is therefore intended that such changes and modifications be covered by the appended claims.

The application is claimed as follows:

1. A liquid crystal display device comprising:

for each pixel, a first switching element provided in common for a plurality of subpixels making up a pixel, the first switching element having a first end connected to a signal line;

for each pixel, a plurality of second switching elements one provided for each subpixel, each of the plurality of second switching elements being connected between the pixel electrode of one of the plurality of subpixels and a second end of the first switching element; and a drive section configured to turn on and off the plurality of second switching elements in sequence during an on period of the first switching element and turn off the second switching element that turns on last in sequence first, and then turn off the first switching element after the last second switching element turns off and then a given period of the time elapses such that the condition affecting the plurality of subpixels due to coupling through parasitic capacitance at the control electrode of the switching elements is the same for the plurality of subpixels, wherein each of the plurality of subpixels includes a capacitive element, wherein the first switching element has no direct connection to the capacitive element of each of the plurality of subpixels, and wherein amounts of electric charge held in the capacitive elements for each of the plurality of subpixels are not increased in a period after the last second switching element is turned off until the first switching element is turned off.

2. The liquid crystal display device of claim 1, wherein each of the plurality of subpixels includes the capacitive element configured to hold a signal potential reflecting a gray level supplied from the signal line via each of the first switching element and the plurality of second switching elements, and the pixel includes a polarity inversion section provided in common for the plurality of subpixels and is configured to invert the polarity of the signal potentials held by the capacitive elements of the plurality of subpixels and rewrite the signal potentials, whose polarity has been inverted, to the capacitive elements.

3. The liquid crystal display device of claim 2, wherein the first switching element turns on in a first operation mode configured to write the signal potential reflecting a gray level to the capacitive elements and turns off in a second operation mode configured to read the held potentials held by the capacitive elements, invert the polarity of the same potentials with the polarity inversion section and rewrite the potentials, whose polarity has been inverted, to the capacitive elements, and the plurality of second switching elements turn on during a read period in which the held potentials held by the capacitive elements are read and during a rewrite period in which the potentials, whose polarity has been inverted with the polarity inversion section, are rewritten to the capacitive elements in the first and second operation modes.

4. The liquid crystal display device of claim 3, wherein the polarity inversion section includes an inverter circuit adapted to invert the polarity of the signal potentials held by the capacitive elements of the plurality of subpixels.

5. The liquid crystal display device of claim 4, wherein the polarity inversion section comprises:

a third switching element connected between the other end of the first switching element and an input terminal of the inverter or latch circuit, the third switching element adapted to turn off in the first operation mode and turn on during the read period in the second operation mode so as to read the potentials held by the capacitive elements via the plurality of second switching elements and supply the potentials to the input terminal of the inverter or latch circuit; and a fourth switching element connected between the other end of the first switching element and an output terminal of the inverter or latch circuit, the fourth switching element adapted to turn off in the first operation mode and turn on during the rewrite period in the second operation mode so as to write the potentials, whose polarity has been inverted with the inverter or latch circuit, to the capacitive elements via the plurality of second switching elements.

6. The liquid crystal display device of claim 3, wherein the polarity inversion section includes a latch circuit adapted to invert the polarity of the signal potentials held by the capacitive elements of the plurality of subpixels and hold the potentials whose polarity has been inverted.

7. The liquid crystal display device of claim 1, wherein the first switching element is provided in common for all of the plurality of subpixels making up the pixel.

8. A driving method of a liquid crystal display device, the liquid crystal display device including, for each pixel, a first switching element provided in common for a plurality of subpixels making up a pixel, the first switching element having a first end connected to a signal line and a plurality of second switching elements one provided for each subpixel, each of the plurality of second switching elements being connected between the pixel electrode of one of the plurality of subpixels and a second end of the first switching element, each of the plurality of subpixels including a capacitive element, and the first switching element having no direct connection to the capacitive element of each of the plurality of subpixels, the driving method comprising:

turning on and off the plurality of second switching elements in sequence during an on period of the first switching element; and turning off the second switching element that turns on last in sequence first, and then turning off the first switching element after the last second switching element turns off and a given period of the time elapses such that the condition affecting the plurality of subpixels due to coupling through parasitic capacitance at the control electrode of the switching elements is the same for the plurality of subpixels, wherein amounts of electric charge held in the capacitive elements for each of the plurality of subpixels are not increased in a period after the last second switching element is turned off until the first switching element is turned off.

9. The driving method according to claim 8, wherein the first switching element is provided in common for all of the plurality of subpixels making up the pixel.

10. An electronic equipment having a liquid crystal display device, the liquid crystal display device comprising:

for each pixel, a first switching element provided in common for a plurality of subpixels making up a pixel, the first switching element having a first end connected to a signal line;

for each pixel, a plurality of second switching elements one provided for each subpixel, each of the plurality of second switching elements being connected between the pixel electrode of one of the plurality of subpixels and a second end of the first switching element; and a drive section configured to turn on and off the plurality of second switching elements in sequence during an on period of the first switching element and turn off the second switching element that turns on last in sequence first, and then turn off the first switching element after the last second switching element turns off and a given period of the time elapses such that the condition affecting the plurality of subpixels due to coupling through parasitic capacitance at the control electrode of the switching elements is the same for the plurality of subpixels, wherein each of the plurality of subpixels includes a capacitive element, and the first switching element has no direct connection to the capacitive element of each of the plurality of subpixels, and wherein amounts of electric charge held in the capacitive elements for each of the plurality of subpixels are not increased in a period after the last second switching element is turned off until the first switching element is turned off.

11. The electronic equipment according to claim 10, wherein the first switching element is provided in common for all of the plurality of subpixels making up the pixel.

* * * * *